US011282658B2

(12) United States Patent
Nobuhiro et al.

(10) Patent No.: US 11,282,658 B2
(45) Date of Patent: Mar. 22, 2022

(54) ENABLING SWITCH

(71) Applicant: IDEC CORPORATION, Osaka (JP)

(72) Inventors: Masaki Nobuhiro, Osaka (JP); Masatake Yamano, Osaka (JP); Takao Fukui, Osaka (JP)

(73) Assignee: IDEC CORPORATION

( * ) Notice: Subject to any disclaimer, the term of this patent is extended or adjusted under 35 U.S.C. 154(b) by 0 days.

(21) Appl. No.: 17/273,749

(22) PCT Filed: Sep. 24, 2019

(86) PCT No.: PCT/JP2019/037245
§ 371 (c)(1),
(2) Date: Mar. 5, 2021

(87) PCT Pub. No.: WO2020/067001
PCT Pub. Date: Apr. 2, 2020

(65) Prior Publication Data

US 2021/0319965 A1 Oct. 14, 2021

(30) Foreign Application Priority Data

Sep. 28, 2018 (JP) ..... JP2018-183375
Sep. 28, 2018 (JP) ..... JP2018-183376
Sep. 28, 2018 (JP) ..... JP2018-183377

(51) Int. Cl.
*H01H 13/20* (2006.01)
*H01H 13/64* (2006.01)
*H01H 13/28* (2006.01)

(52) U.S. Cl.
CPC ..... *H01H 13/64* (2013.01); *H01H 13/20* (2013.01); *H01H 13/28* (2013.01)

(58) Field of Classification Search
CPC ..... H01H 13/14; H01H 13/52; H01H 13/04; H01H 13/10; H01H 13/705; H01H 13/20;
(Continued)

(56) References Cited

U.S. PATENT DOCUMENTS 6,193,566 B1 * 2/2001 Isobe ..... H01R 4/305 439/801
6,288,352 B1 9/2001 Fukui et al. ..... 200/435
(Continued)

FOREIGN PATENT DOCUMENTS

JP 2001-035300 A 2/2001
JP 2002-042606 A 2/2002
(Continued)

OTHER PUBLICATIONS

International Search Report dated Dec. 17, 2019 in corresponding PCT International Application No. PCT/JP2019/037245.
(Continued)

*Primary Examiner* — Ahmed M Saeed
(74) *Attorney, Agent, or Firm* — Ostrolenk Faber LLP

(57) ABSTRACT

When an initial position of an enabling switch is given as a first position (301), a position of the enabling switch in which a movable member is most pressed is given as a third position (303), and a rising start position of a maximum rise of a load is given as a second position (302), the rising start position being between the first position (301) and the third position (303), a minor peak (341) of the load appears between the first position (301) and the second position (302). An ON switching position (311) is between a falling start position (323) of the minor peak (341) and the second position (302). A maximum load during the minor peak (341) is greater than or equal to the load in the ON switching position (311) and less than or equal to the load in an OFF switching position (312).

13 Claims, 39 Drawing Sheets

(58) Field of Classification Search
CPC ..... H01H 13/50; H01H 3/12; H01H 13/64; H01H 13/28; H01H 9/28; H01H 9/286; H01H 9/287; H01H 2300/024; H01H 9/282; H01H 9/283; H01H 9/20; H01H 9/281; H01H 9/26; H01H 21/22; H01H 2009/265; H01H 2221/052; H01H 71/521; H01H 71/1018
See application file for complete search history.

(56) References Cited

U.S. PATENT DOCUMENTS

| | | | | |
|---|---|---|---|---|
| 2003/0027107 | A1 | 2/2003 | Fukui et al. | 434/100 |
| 2004/0065535 | A1 | 4/2004 | Fukui et al. | 200/553 |
| 2013/0319839 | A1* | 12/2013 | Taniguchi | H01H 1/20 200/530 |

FOREIGN PATENT DOCUMENTS

| | | | |
|---|---|---|---|
| JP | 2002-075121 | A | 3/2002 |
| JP | 2005-056635 | A | 3/2005 |
| JP | 2008-124040 | A | 5/2008 |
| WO | WO 2002/061779 | A1 | 8/2002 |

OTHER PUBLICATIONS

Written Opinion dated Dec. 17, 2019 in corresponding PCT International Application No. PCT/JP2019/037245.
PCT/IB/326—Notification Concerning Transmittal of International Preliminary Report on Patentability including PCT/IB/373 and PCT/ISA/237 (in Japanese) dated Apr. 8, 2021 for International Application No. PCT/JP2019/037245, 8 pages.
PCT/IB/338—Notification of Transmittal of Translation of the International Preliminary Report on Patentability including PCT/IB/373 and PCT/ISA/237 (in English) dated Apr. 8, 2021 for International Application No. PCT/JP2019/037245, 11 pages.

* cited by examiner

ENABLING SWITCH

CROSS-REFERENCE TO RELATED APPLICATIONS

The present application is a 35 U.S.C. §§ 371 national phase conversion of International Application No. PCT/JP2019/037245, filed Sep. 24, 2019, which claims priority to Japanese Patent Application Nos. 2018-183375, 2018-183376, and 2018-183377, filed Sep. 28, 2018, the contents of all of which are incorporated herein by reference. The PCT International Application was published in the Japanese language.

TECHNICAL FIELD

The present invention relates to an enabling switch for enabling operation of an operation target by an operation part.

BACKGROUND ART

Conventionally, switches are known that transition from an OFF state to an ON state and further from the ON state to the OFF state in accordance with the amount of press of their movable member. Such switches are used as "enabling switches" of operation parts that serve as terminals through which operators do input when operating robots or machines. When doing input, an operator maintains a switch in an ON state. When the switch has entered an OFF state, input from the operator is interrupted and is not transmitted to an operation target such as a robot. Thus, in cases such as where the operator has moved his or her hands off the operation part or where the operator has strongly grasped the operation part in surprise or other emotional states, input to the operation part is not transmitted to the operation target, and the safety of the operator is ensured. Examples of such enabling switches include switches disclosed in Japanese Patent Application Laid-Open No. 2001-35300, Japanese Patent Application Laid-Open No. 2002-42606, International Publication No. WO/2002/061779, and Japanese Patent Application Laid-Open No. 2005-56635.

Like the aforementioned switches, the switch disclosed in Japanese Patent Application Laid-Open No. 2002-75121 performs a three-position (OFF-ON-OFF) operation. Initial switching from an OFF-state operation to an ON-state operation is actuated by snap action of switch actuating means, and the next switching from the ON-sate operation to the OFF-state operation is also actuated by snap action of the switch actuating means. This provides the operator an operating feel at the time of state switching.

Incidentally, in the switch disclosed in Japanese Patent Application Laid-Open No. 2002-75121, when a plunger serving as a movable member is pressed to make a transition from an OFF state to an ON state, a pressing force or a load increases gradually relative to the amount of press. Thus, the switch provides only a small tactile click feel when transitioning from the OFF state to the ON state, and consequently even after the switch has transitioned to the ON state, the operator continues to press the movable member gradually. As a result, even if the load is increased relative to the amount of press immediately before a further transition from the ON state to the OFF state, this increase may not be felt clearly by the operator.

When the pressing force or the load increases gradually relative to the amount of press, the operator can easily press the movable member slowly. However, there is a usage pattern of an enabling switch in which the enabling switch includes two contacts in order to improve reliability of the enabling switch, and if there is a large difference in switching timing between the two contacts, the operation part determines that the enabling switch is faulty.

In the case of this usage pattern, when the movable member is pressed slowly in a slightly inclined position, the difference in switching timing between the two contacts will increase and may be misdetected as an error.

SUMMARY OF INVENTION

The present invention has been made in view of the problem described above, and it is an object of the present invention to provide an enabling switch that enables an operator to clearly feel an increase in load relative to the amount of press at a stage before the switch is further pressed from an ON state and transitions to an OFF state.

It is also an object of the present invention to provide an enabling switch that includes two contacts and enables reducing a difference in switching timing between the two contacts.

The present invention is directed to an enabling switch provided in an operation part and for enabling operation of an operation target by an operation part.

An enabling switch according to a preferable aspect of the present invention includes a holder, a movable member that is pressed toward the holder, a contact, and a contact mechanism that causes the contact to transition from an open state to a closed state and further from the closed state to the open state in accordance with a press of the movable member toward the holder.

Here, a position of the movable member relative to the holder in a state in which the movable member is not pressed is given as a first position, a position of the movable member relative to the holder in a state in which the movable member is most pressed is given as a third position, and a rising start position of a maximum rise of a load required to press the movable member is given as a second position, the rising start position being between the first position and the third position, and the maximum rise being a rise in which the load rises and reaches its maximum with an increase in a rate of increase of the load relative to an amount of press.

When the movable member is pressed, the contact transitions from the open state to the closed state in an ON switching position that is between the first position and the second position, and the contact transitions from the closed state to the open state in an OFF switching position that is between the second position and the third position. A minor peak in which the load once rises and then decreases when the movable member is pressed appears between the first position and the second position. The ON switching position is between a falling start position of the minor peak and the second position. A maximum load during the minor peak is greater than or equal to a load in the ON switching position and less than or equal to a load in the OFF switching position.

According to the present invention, it is possible to provide an enabling switch that enables an operator to clearly feel an increase in load relative to the amount of press at a stage before the switch is further pressed from an ON state and transitions to an OFF state.

Preferably, the maximum load during the minor peak is less than a load in a position immediately before the OFF switching position and greater than a load in the second position.

In a preferable embodiment, the contact is closed when two terminals included in the contact gradually approach and come in contact with each other as the movable member is pressed in close proximity to the ON switching position toward the holder.

In a preferable embodiment, the enabling switch further includes a first engaging part, and a second engaging part that moves relative to the first engaging part in accordance with movement of the movable member. When the movable member is pressed toward the holder, engagement of the first engaging part and the second engaging part is released during the minor peak of the load.

In another preferable embodiment, the enabling switch further includes a second contact, and the contact is a first contact.

The contact mechanism causes the first contact and the second contact to transition from an open state to a close state and further from the closed state to the open state as the movable member is pressed toward the holder. The ON switching position is a first ON switching position, and the OFF switching position is a first OFF switching position.

When the movable member is pressed, the second contact transitions from the open state to the closed state in a second ON switching position that is between the first position and the second position, and the second contact transitions from the closed state to the open state in a second OFF switching position that is between the second position and the third position. The first ON switching position and the second ON switching position are the same or in close proximity to each other, and the first OFF switching position and the second OFF switching position are the same or in close proximity to each other, The second ON switching position is between a falling start position of the minor peak and the second position. The maximum load during the minor peak is greater than or equal to a greater one of a load in the first ON switching position and a load in the second ON switching position and less than a smaller one of a load in the first OFF switching position and a load in the second OFF switching position.

According to the present invention, it is possible to provide an enabling switch that enables reducing a difference in switching timing between the two contacts.

Preferably, the maximum load during the minor peak is less than a load in a position immediately before the second OFF switching position and greater than a load in the second position.

In a preferable embodiment, the enabling switch further includes a first engaging part, and a second engaging part that moves relative to the first engaging part in accordance with movement of the movable member. When the movable member is pressed toward the holder, engagement of the first engaging part and the second engaging part is released during the minor peak of the load.

Preferably, in the above-described preferable embodiment, the movable member is transversely elongated and pressed toward the holder in a direction perpendicular to a direction of elongation of the movable member. The contact mechanism includes a rotatable member that is long in the direction of elongation of the movable member and rotatable about a rotation axis parallel to the direction of elongation. The rotatable member is rotatably mounted directly or indirectly on either one of the movable member and the holder. The movable member is pressed toward the holder when the rotatable member is rotated with a press of the movable member while rotatable sliding contact parts that are located in opposite ends of the rotatable member in a longitudinal direction are in sliding contact with fixed sliding contact parts that are directly or indirectly fixed to the other of the movable member and the holder. The fixed sliding contact parts include the first engaging part, and the rotatable sliding contact parts serve as the second engaging part.

Preferably, the enabling switch further includes an elastic body that exerts a force between the first engaging part and the second engaging part. When the movable member is pressed toward the holder, the second engaging part moves against the force exerted from the elastic body during the minor peak of the load so as to release engagement of the first engaging part and the second engaging part.

Preferably, the maximum load during the minor peak is less than a load in a position immediately before the second OFF switching position and greater than a load in the second position.

In a preferable embodiment, the elastic body is directly or indirectly fixed to either one of the movable member and the holder. The second engaging part is directly or indirectly mounted on the elastic body. The first engaging part is directly or indirectly fixed to the other of the movable member and the holder.

In either of the above-described enabling switches, it is preferable that the minor peak rises almost vertically.

More preferably, a position of the maximum load during the minor peak is closer to the first position than to a midpoint position between the first position and the second position.

These and other objects, features, aspects and advantages of the present invention will become more apparent from the following detailed description of the present invention when taken in conjunction with the accompanying drawings.

DESCRIPTION OF EMBODIMENTS

Figure 1:
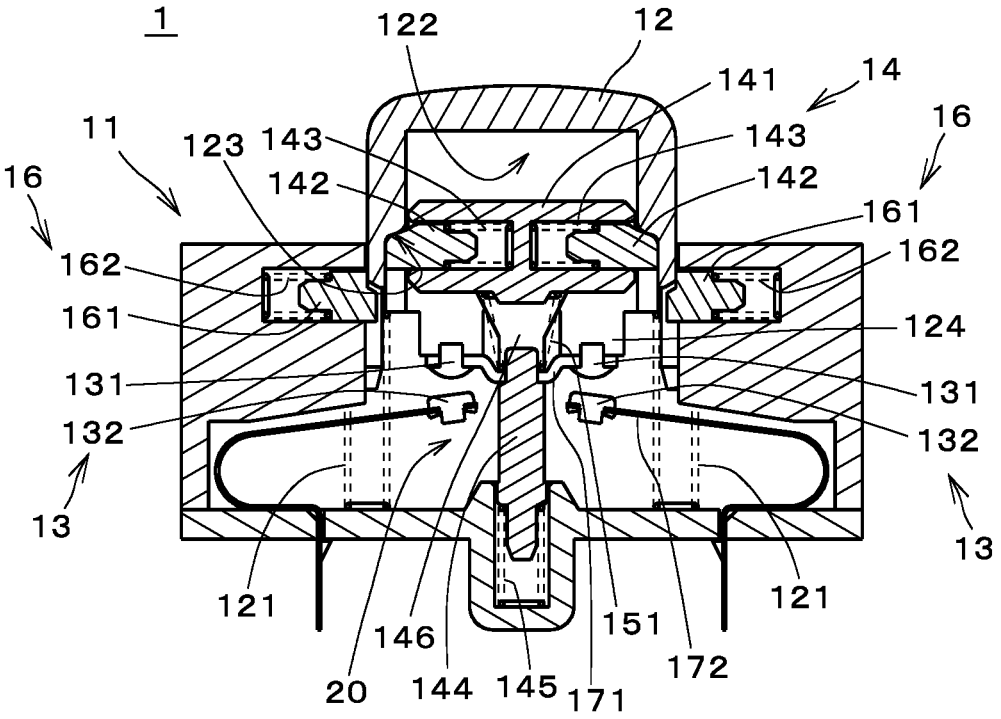
FIG. 1 is a longitudinal sectional view of an enabling switch.

FIG. 1 is a longitudinal sectional view of an enabling switch 1 provided in an operation part such as a teach pendant of a robot or a controller of a work machine. Equipment such as a robot or a work machine is an operation target of the operation part. The enabling switch 1 enables operation of the operation target by the operation part. During an ON state of the enabling switch 1, operation of the operation target is enabled, and when an operator does input to the operation part, a signal based on the input received from the operation part is transmitted to the operation target. During an OFF state of the enabling switch 1, operation of the operation target is disabled, and input from the operator is not transmitted to the operation target.

In FIG. 1, details and cross-hatching in sections of members that are not important in the description shall be omitted. The enabling switch 1 includes a holder 11 and a movable member 12. In the operation of the enabling switch 1, the movable member 12 is pressed downward in FIG. 1 into the holder 11 by an operator. The up-down direction in FIG. 1 does not necessarily have to match with the direction of gravity. The holder 11 supports members of the enabling switch 1 other than the holder 11. Coil springs 121 in the holder 11 apply a force that is exerted upward in FIG. 1 on the movable member 12. In FIG. 1, the coil springs 121 and other coil springs are indicated by broken lines in simplified form. When the operator has pressed the movable member 12 into the holder 11 with his or her finger and then moved the finger off the movable member 12, the movable member 12 is returned to its original position by the force of the coil springs 121.

The enabling switch 1 includes, in the holder 11, two contacts 13 and a contact mechanism 20 that causes the contacts 13 to transition to an open or closed state. Each contact 13 is a combination of an upper terminal 131 and a lower terminal 132. In the open state of each contact 13, the upper terminal 131 and the lower terminal 132 are spaced from each other. In the closed state of each contact 13, the upper terminal 131 and the lower terminal 132 are in contact with each other. In the open state of the contacts 13, the enabling switch 1 is in an OFF state, and in the closed state of the contacts 13, the enabling switch 1 is in an ON state.

The movable member 12 has an upwardly recessed hole 122. The hole 122 has an inclined face 123 that is inclined upward toward the inside in the lateral direction in FIG. 1. In the hole 122, an OFF switching mechanism 14 is arranged. The OFF switching mechanism 14 includes a supporter 141, two engaging parts 142, two coil springs 143, a lower abutment part 144, and a coil spring 145. The supporter 141 and the lower abutment part 144 are connected via a connector part 146 and each configure part of a single member. The supporter 141 has bearing holes that are open on the right and left sides. The engaging parts 142 and the coil springs 143 are located in the bearing holes, and the coil springs 143 press the engaging parts 142 outward in the lateral direction from the inside of the bearing holes.

In the initial state illustrated in FIG. 1, the OFF switching mechanism 14 receives a force exerted upward from the coil spring 145 and causes the engaging parts 142 and the inclined face 123 to abut on and be engaged with each other. Accordingly, the supporter 141 is located at approximately the height of the inclined face 123.

The upper terminals 131 are provided on metal plates 171 that are in contact with the lower abutment part 144. A coil spring 151 is arranged between the metal plates 171 and the supporter 141. The coil spring 151 serves to press the metal plate 171 down against the lower abutment part 144. A force of contact between the upper terminals 131 and the lower terminals 132 is adjusted using the resilience of the coil spring 151 and long metal plates 172. The lower terminals 132 are provided on the upper ends of the long metal plates 172. The lower ends of the metal plates 172 are fixed to the bottom face of the holder 11. The metal plates 172 are curved and function as flat springs.

As will described later, the OFF switching mechanism 14 and the metal plates 171 and 172 configure the contact mechanism 20 that causes the contacts 13 to transition from an open state to a closed state and further from the closed state to the open state as the movable member 12 is pressed toward the holder 11. Since, as will be described later, a lower portion 124 of the movable member 12 serves to maintain the contacts 13 in the open state during a period of time when the movable member 12 returns from its most pressed position to its original position, the lower portion 124 may also be regarded as part of the contact mechanism 20. The enabling switch 1 includes the two contacts 13, and when these contacts are distinguished respectively as a "first contact 13" and a "second contact 13," the contact mechanism 20 causes the first contact 13 and the second contact 13 to transition from an open state to a closed state and further from the closed state to the open state as the movable member 12 is pressed toward the holder 11.

In the holder 11, two resistance mechanisms 16 are provided laterally to the movable member 12. The resistance mechanisms 16 are provided in holes of the holder 11 that are recessed outward in the lateral direction. The resistance mechanisms 16 each include an engaging part 161 and a coil spring 162. More correctly, portions of the holder 11 that are located in close proximity to the engaging parts 161 and the coil springs 162 also form part of the resistance mechanisms 16. The coil springs 162 press the engaging parts 161 toward the inside of the holder 11 in the lateral direction, i.e., toward the movable member 12. In the initial state illustrated in FIG. 1, the tips of the engaging parts 161 are located on the underside of the lower edge of the outer side face of the movable member 12. As will be described later, the resistance mechanisms 16 exert a force resistant to the movement of the movable member 12 on the movable member 12 at an initial stage of the press of the movable member 12.

Figure 2:
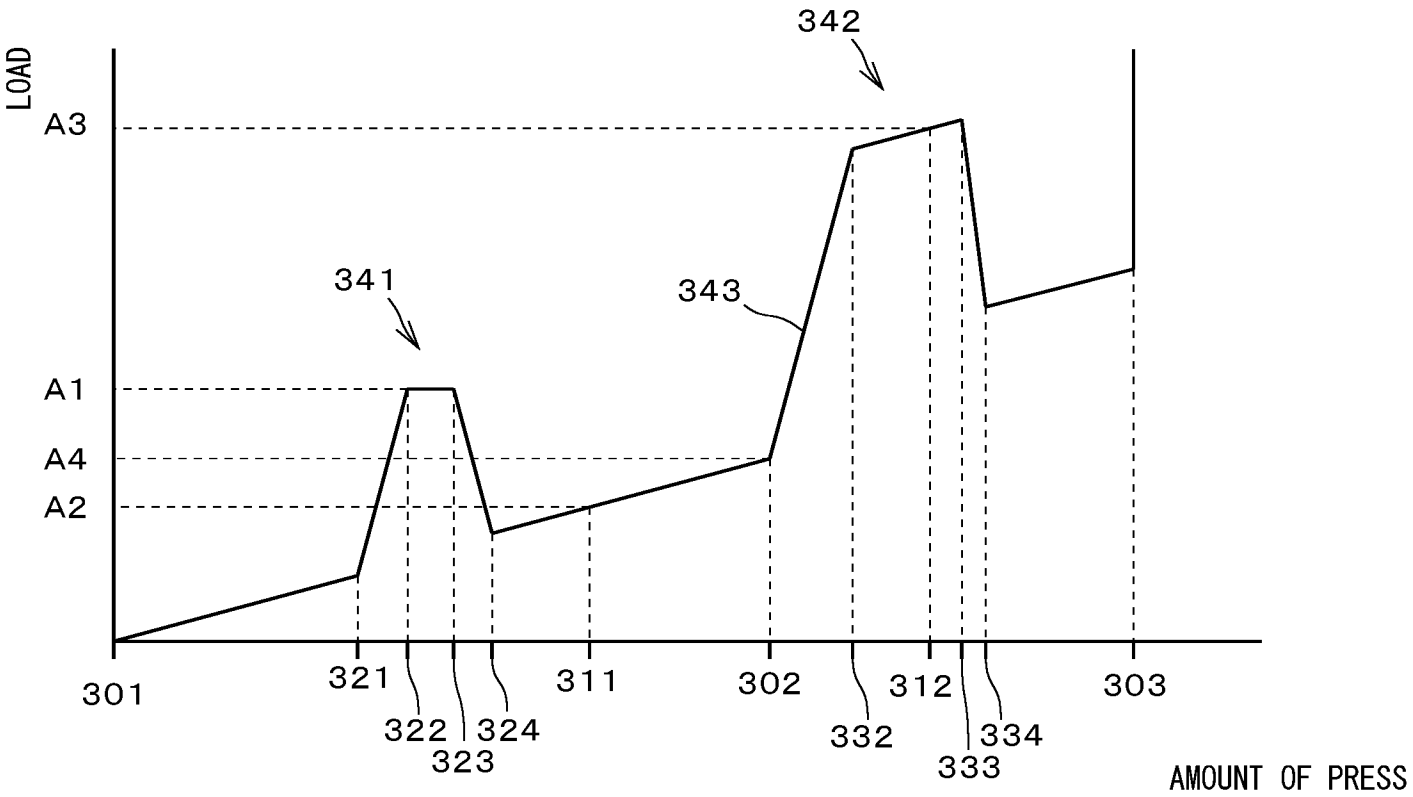
FIG. 2 is a diagram illustrating an outline of the relationship between the load and the amount of press of the enabling switch.

Next is a description of a preferable change in load that is a force required to press the enabling switch 1 with a press of the movable member 12. FIG. 2 is a diagram illustrating an outline of the relationship between the load and the amount of movement of the movable member 12, i.e., the amount of press of the enabling switch 1. Hereinafter, the position of the movable member 12 corresponding to the amount of press will be described with reference to the reference signs given in FIG. 2.

In FIG. 2, a position 301 is the initial position. Hereinafter, the position 301 is referred to as a "first position." The first position 301 is the position of the movable member 12 relative to the holder 11 in a state in which the movable member 12 is not pressed. A position 303 is the position of the movable member 12 relative to the holder 11 in a state in which the movable member 12 is most pressed. Hereinafter, the position 303 is referred to as a "third position." In the third position 303, the enabling switch 1 is in an OFF state.

A position 302 is the position in which the movable member 12 is pressed to some extent and can be held stably while the operator feels some sort of resistance. Thus, the enabling switch 1 is stably held in an ON state. Hereinafter, the position 302 is referred to as a "second position." The second position 302 is a rising start position of a maximum rise 343 of the load required to press the movable member 12, the rising start position being between the first position 301 and the third position 303, and the maximum rise being a rise in which the load rises and reaches its maximum in accordance with an increase in the rate of increase of the load relative to the amount of press.

A position 311 is an "ON switching position" in which the contacts 13 transition from an open state to a closed state with a press and the enabling switch 1 transitions from an OFF state to an ON state. A position 312 is an "OFF switching position" in which the contacts 13 transition from the closed state to the open state and the enabling switch 1 transitions from the ON state to the OFF state. Accordingly, in the enabling switch 1, with a press of the movable member 12, the contacts 13 transition from an open state to a closed state in the ON switching position 311 between the first position 301 and the second position 302, and the contacts 13 transition from the closed state to the open state in the OFF switching position 312 between the second position 302 and the third position 303.

More correctly, the enabling switch 1 includes the two contacts 13, and when these contacts are distinguished respectively as a "first contact 13" and a "second contact 13," with a press of the movable member 12, the first contact 13 transitions from an open state to a closed state in a first ON switching position that is between the first position 301 and the second position 302, the first contact 13 transitions from the closed to the open state in a first OFF switching position that is between the second position 302 and the third position 303, the second contact 13 transitions from an open state to a closed state in a second ON switching position that is between the first position 301 and the second position 302, and the second contact 13 transitions from the closed state to the open state in a second OFF switching position that is between the second position 302 and the third position 303.

In the case of the first contact 13, the position 311 in FIG. 2 corresponds to the first ON switching position, and the position 312 corresponds to the first OFF switching position 312. In the case of the second contact 13, the position 311 corresponds to the second ON switching position, and the position 312 corresponds to the second OFF switching position 312. The first ON switching position and the second ON switching position are the same or in close proximity to each other, and the first OFF switching position and the second OFF switching position are the same or in close proximity to each other.

In the enabling switch 1, a minor peak 341 in which the load once rises and then decreases with a press of the movable member 12 appears between the first position 301 and the second position 302. In FIG. 2, a reference sign 321 is assigned to the position in which the minor peak 341 starts to rise, a reference sign 322 is assigned to the position in which the rising ends and a certain degree of load starts to be maintained, a reference sign 323 is assigned to the position in which the minor peak starts to fall, and a reference sign 324 is assigned to the position in which the falling ends. However, these positions do not necessarily have to appear obviously, and it these positions do not appear obviously, various methods may be used to specify these positions. For example, when the rising start position 321 and the falling end position 324 are on the curve, the positions in which the curvature reaches its maximum may be specified as the positions 321 and 324. The positions 322 and 323 may also be determined in the same manner, and these positions 322 and 323 may be the same. For example, in the case where the minor peak 341 has a sharp top, the positions 322 and 323 are specified as the same position.

As another technique, for example, the position in which a gradient of the load with increasing amount of press exceeds a given positive value may be specified as the rising start position 321, the position in which the gradient falls below the given value may be specified as the rising end position 322, the position in which the gradient falls below a given negative value may be specified as the falling start position 323, and the position in which the gradient exceeds the given value may be specified as the falling end position 324.

Similarly, a rising start position (second position 302), a rising end position 332, a falling start position 333, and a falling end position 334 of a peak between the second position 302 and the third position 303 may be determined using various techniques as long as these positions indicate approximately their respective meanings. The rising end position 332 and the falling start position 333 may be the same. Hereinafter, the peak from the position 302 to the position 334 is referred to as a "major peak 342."

In the enabling switch 1 illustrated in FIG. 1, the ON switching position 311 (in the presence of the two contacts 13, the first ON switching position and the second ON switching position; the same applies to the following description) is between the falling end position 324 of the minor peak 341 and the second position 302. A maximum load A1 during the minor peak is greater than or equal to a load A2 in the ON switching position 311 (in the presence of the two contacts 13, a greater one of the load in the first ON switching position and the load in the second ON switching position) and less than a load A3 in the OFF switching position 312 (in the presence of the two contacts 13, a smaller one of the load in the first OFF switching position and the load in the second OFF switching position).

Accordingly, when the movable member 12 starts to be pressed, the movable member 12 is pressed abruptly after a slightly resistive tactile click feel and transitions to the second position 302. That is, during normal operation, the movable member 12 cannot be stopped partway after the minor peak 341 and speedily transitions to the second position 302 with a feel that the movable member 12 strikes something. As a result, the operator is able to clearly feel that the movable member 12 has reached the second position 302. In other words, the operator is able to clearly feed an increase in load relative to the amount of press at a stage before the switch is further pressed from the ON state in the second position 302 and transitions to the OFF state in the third position 303.

From the above-described viewpoint, the ON switching position 311 is not limited to the position illustrated in FIG. 2. The ON switching position 311 may be any position between the falling start position 323 of the minor peak 341 and the second position 302. From the viewpoint of causing the movable member 12 to speedily transition from the minor peak 341 to the second position 302, the maximum load A1 during the minor peak 341 is preferably greater than a load A4 in the second position 302. Moreover, in order to prevent the switch that has passed the minor peak 341 from transitioning to the OFF state beyond the second position 302, the maximum load during the minor peak 341 is preferably less than the load in a position immediately before the OFF switching position 312 (in the presence of the two contacts 13, the loads in positions immediately before the first OFF switching position and the second OFF switching position; in general, the load in the position 332).

The rising start position 321 of the minor peak 341 may be almost or exactly the same as the first position 301. Even in this case, the operator is able to receive a resistive feel when the movable member 12 is pressed. In particular, when the minor peak 341 rises almost vertically, i.e., when the positions 321 and 322 are almost the same, the operator is able to more clearly receive a resistive feel. Of course, even if the rising start position 321 of the minor peak 341 is apart from the first position 301, it is preferable that the minor peak 341 rises almost vertically.

Moreover, in order for the operator to clearly feel the transition to the second position 302 after having received a resistive feel with a press of the movable member 12, it is preferable that the minor peak 341 and the second position 302 are apart enough from each other. Specifically, the position of the maximum load during the minor peak 341 is preferably closer to the first position 301 than to a midpoint position between the first position 301 and the second position 302. This is because, if the minor peak 341 is close to the second position 302, the minor peak 341 may be misdetected as the major peak 342.

In the enabling switch 1 having the characteristics illustrated in FIG. 2, even with the provision of the minor peak 341, there is no need to change a design load necessary to hold the movable member 12 in the second position 302. Thus, even if the operation part including the enabling switch 1 has been grasped in the second position 302 for a long time, strain will not be imposed on the operator. Moreover, the provision of the minor peak 341 brings about the effect of preventing the enabling switch 1 from unintentionally transitioning to an ON state in cases such as where the movable member 12 is touched by mistake or where the movable member 12 comes in contact with other objects.

Although the change in load from the falling of the minor peak 341 to the second position 302 is indicated by the straight line in FIG. 2, the change is not limited to a change indicated by the straight line as long as there are no large changes. For example, the rate of change in load may be changed in the ON switching position 311 and the load curve may be bent, or the load may slightly change stepwise in the ON switching position 311.

Next is a description of how the enabling switch 1 illustrated in FIG. 1 achieves the characteristics illustrated in FIG. 2.

Figure 3:
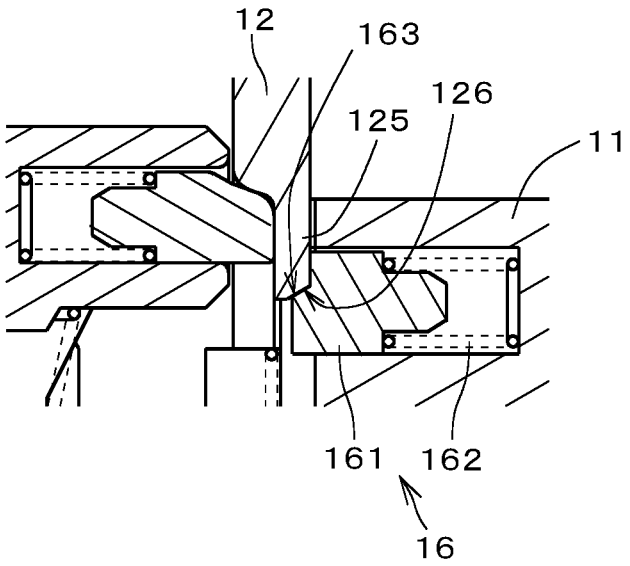
FIG. 3 is a longitudinal sectional view illustrating an area in close proximity to a resistance mechanism.

When the movable member 12 starts to be pressed from the first position 301, the coil springs 121 and the coil spring 145 are compressed, and as illustrated in FIG. 3, inclined faces 126 located in the lower portion of the movable member 12 and inclined faces 163 at the tips of the engaging parts 161 of the resistance mechanisms 16 are brought into abutment with each other. Hereinafter, portions 125 of the movable member 12 in close proximity to the inclined faces 126 are referred to as "engaging parts." This increases the load that presses the movable member 12. The position of the movable member 12 illustrated in FIG. 3 is the rising start position 321 of the minor peak 341. In the first position 301, the inclined faces 126 and the inclined faces 163 (whose reference signs shall be omitted in FIG. 1) are slightly spaced from each other as illustrated in FIG. 1, and the first position 301 and the position 321 are close to each other.

Figure 4:
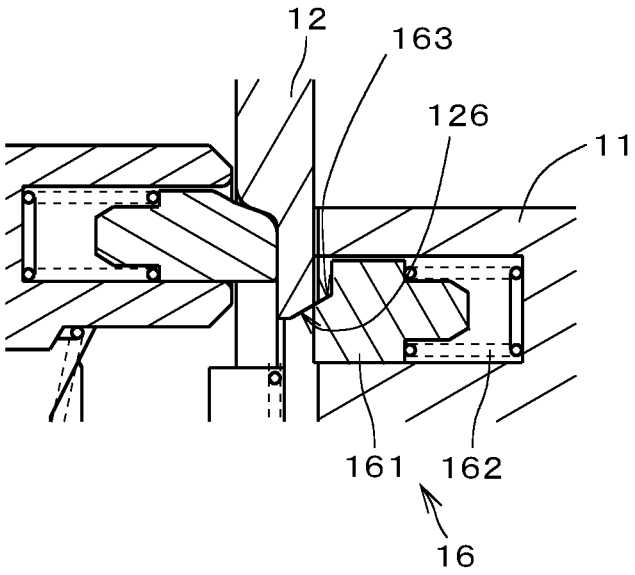
FIG. 4 is a longitudinal sectional view illustrating the area in close proximity to the resistance mechanism.

The inclined faces 126 are inclined upward toward the outside in the lateral direction. The inclined faces 163 are inclined downward toward the inside in the lateral direction. Thus, if the load applied to the movable member 12 increases, the engaging parts 161 start to move outward in the lateral direction against the force exerted from the coil springs 162 as illustrated in FIG. 4. This state is the state of transition from the position 321 to the position 323.

Figure 5:
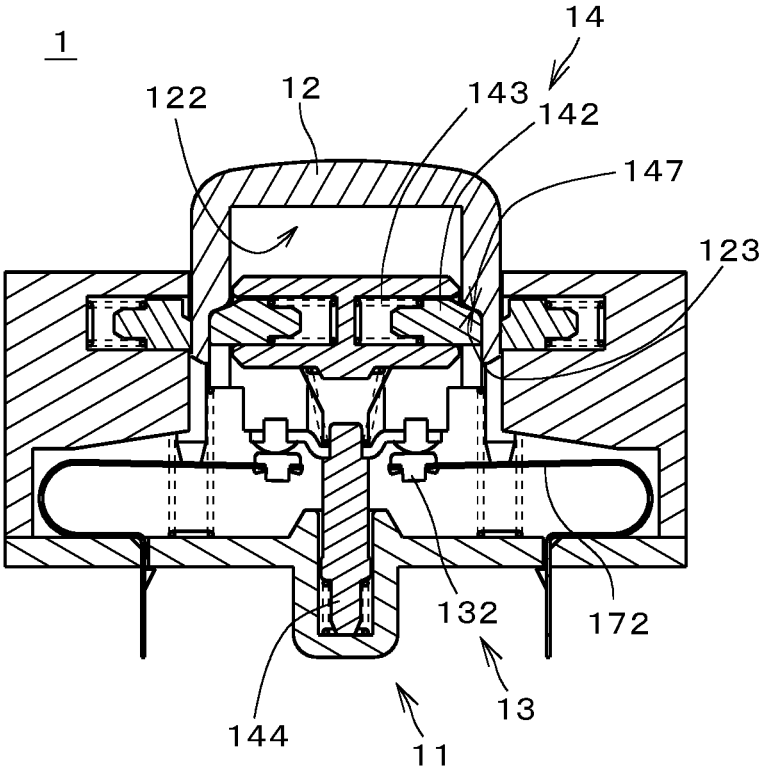
FIG. 5 is a longitudinal sectional view of the enabling switch when a movable member is located in a second position.

When the edges of the inclined faces 126 have matched with the edges of the inclined faces 163, the engagement of the engaging parts 161 and the engaging parts 125 is released, and the movable member 12 moves downward such that the outer side face of the movable member 12 are rubbing against the tips of the engaging parts 161. At this time, the load decreases abruptly. That is, the movable member speedily reaches the position 324 from the position 323. In the case of the enabling switch 1 in FIG. 1, the positions 323 and 324 are almost the same. If the movable member 12 has further moved downward as illustrated in FIG. 5, the contacts 13 become closed in the position 311, and if the movable member 12 has yet further moved downward, the lower end of the lower abutment part 144 comes in contact with the center of the inner bottom face of the holder 11. The position of the movable member 12 illustrated in FIG. 5 is the second position 302. The lower terminals 132 move downward as a result of the metal plates 172 being bent.

When a downward force is applied to the movable member 12 in the state illustrated in FIG. 5, an upward force relative to the movable member 12 is exerted on the OFF switching mechanism 14. As described previously, the lower portion of the hole 122 of the movable member 12 has the inclined faces 123 inclined upward toward the inside in the lateral direction. The tips of the engaging parts 142 have inclined faces 147 that are inclined downward toward the outside in the lateral direction.

Thus, if the load applied to the movable member 12 increases, the force that is exerted to move the OFF switching mechanism 14 upward relative to the movable member 12 increases, and the engaging parts 142 start to move inward in the lateral direction against the force exerted from the coil springs 143. This state is the state of transition from the position 302 to the position 333 via the position 332. When the edges of the inclined faces 123 have matched with the edges of the inclined faces 147, the OFF switching mechanism 14 is speedily moved upward by the coil spring 145 such that the tips of the engaging parts 142 are rubbing against the inner side face of the hole 122. At this time, the load decreases abruptly. Then, the state illustrated on the left side in FIG. 6 changes instantaneously into the state illustrated on the right side. That is, the switch speedily reaches the position 334 from the position 333. In the case of the enabling switch 1 in FIG. 1, the positions 333 and 334 are almost the same. Through the operation described above, the major peak 342 is obtained.

Figure 6:
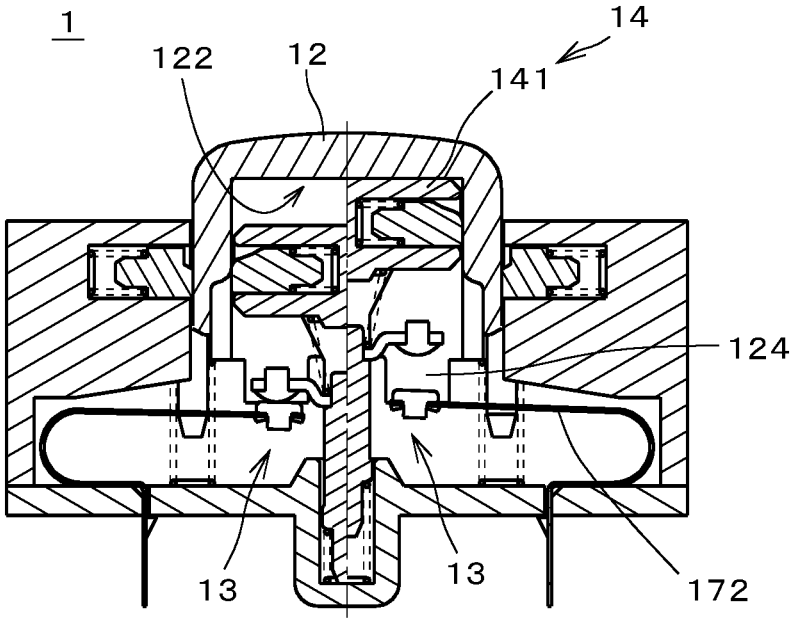
FIG. 6 is a longitudinal sectional view of the enabling switch when an OFF switching mechanism moves upward.

If the OFF switching mechanism 14 moves upward as illustrated in FIG. 6, the upper face of the supporter 141 and the ceiling of the hole 122 come in contact with each other. The contacts 13 transition from the closed state to the open state. On the other hand, the tips of the metal plates 172 come in contact with the lower end of the lower portion 124 of the movable member 12, and a state in which the metal plates 172 are bent to some extent is maintained.

Figure 7:
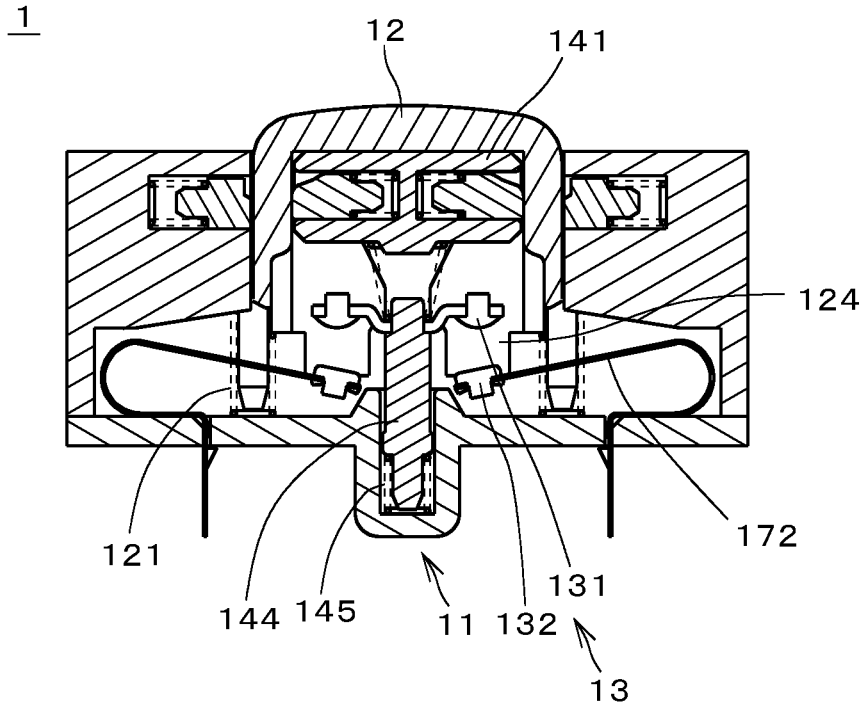
FIG. 7 is a longitudinal sectional view of the enabling switch when the movable member is located in a third position.

If the movable member 12 is further pressed, as illustrated in FIG. 7, the coil spring 145 is compressed again, and the lower abutment part 144 comes again in contact with the bottom face of the holder 11. This state corresponds to the third position 303, and downward movement of the movable member 12 is disabled. At this time, the upper terminals 131 and the lower terminals 132 of the contacts 13 are forced to be located in positions away from each other. Thus, even if the upper terminals 131 and the lower terminals 132 are welded together, the welding is released and the enabling switch 1 is forced to transition to an OFF state by pressing the movable member 12 to the third position 303. In the same manner, when the coil spring 145 is broken and the lower abutment part 144 cannot move upward enough, it is possible to force the enabling switch 1 to transition to an OFF state by strongly pressing the movable member 12.

When the operator has moved his or her finger off the enabling switch 1 in the state illustrated in FIG. 7, the movable member 12 starts to be moved upward by the coil springs 121 and the coil spring 145 while maintaining a state in which the tips of the metal plates 172 are in contact with the lower portion 124 of the movable member 12 and a state in which the supporter 141 and the movable member 12 are vertically in contact with each other, and the contacts 13 are maintained in the open state until the movable member 12 returns to the first position 301 in FIG. 1. That is, the enabling switch 1 is maintained in the OFF state when the movable member 12 is returning from the third position 303. When the operator has moved his or her finger off the movable member 12 in the second position 302, the movable member 12 returns to the first position 301 and the enabling switch 1 returns to the OFF state.

As described above, in the enabling switch 1, the presence of the minor peak 341 prevents operation from being stopped partway in any position between the minor peak 341 and the second position 302 during normal operation and enables the operator to clearly feel that the movable member 12 has reached the second position 302. Although in the enabling switch 1, the two contacts 13 are connected in series and provided as one set of double-pole contacts, two or more sets of double-pole contacts may be provided in a direction perpendicular to the plane of the drawing. In this case, even if the movable member 12 is inclined, it is possible, by making a speedy transition from the minor peak 341 to the second position 302, to considerably shorten the duration of time that two sets of double-pole contacts remain in different states. That is, the difference in switching timing between the two sets of double-pole contacts can be reduced. As a result, it is possible to prevent misdetection of an error caused by the fact that the two contacts 13 remain in different states for a given period of time or more.

In the enabling switch 1, as the movable member 12 is pressed in close proximity to the ON switching position 311 toward the holder 11, the two terminals 131 and 132 included in the contacts 13 gradually approach and come in contact with each other, and thereby the contacts 13 are closed. In this case, it is possible, by making a speedy transition from the minor peak 341 to the second position 302, to suppress discharge occurring when the contacts 13 become closed and to suppress welding of the contacts 13.

The resistance mechanisms 16 in the enabling switch 1 may be modified in various ways. A combination of an engaging part 161 and a coil spring 162 may be provided in various places as long as each place is located between the movable member 12 and the holder 11. For example, as illustrated in the partial enlarged view in FIG. 8, the movable member 12 may include engaging parts 161 and coil springs 162. In this case, the holder 11 has inclined faces 112 that are in sliding contact with inclined faces 163 at the tips of the engaging parts 161.

Figure 8:
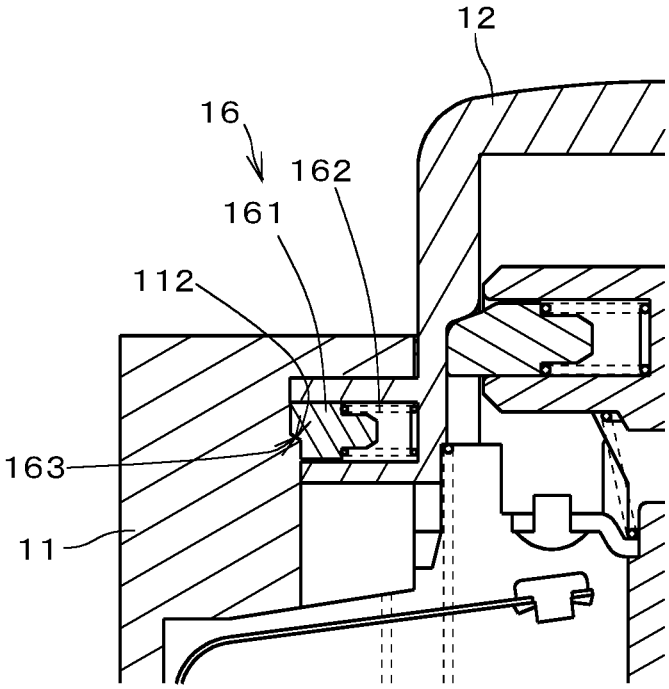
FIG. 8 is a diagram illustrating another example of the resistance mechanism.
Figure 9:
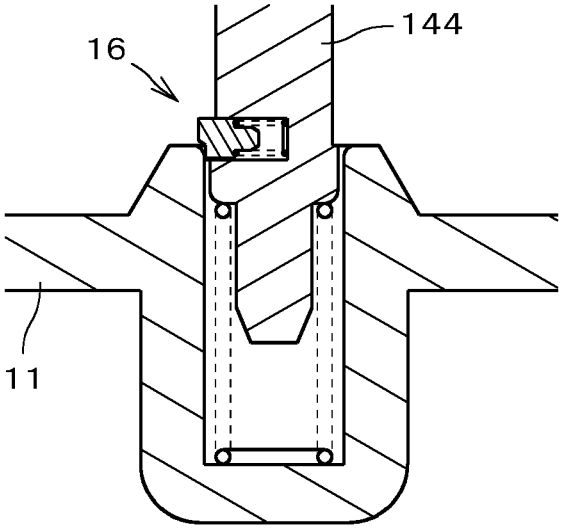
FIG. 9 is a diagram illustrating a yet another example of the resistance mechanism.

The resistance mechanisms 16 may be provided in the OFF switching mechanism 14. FIG. 9 is a diagram illustrating an example in which a resistance mechanism 16 is provided in the lower abutment part 144. In this way, the resistance mechanisms 16 may be provided in various portions that move together with the movable member 12 when the movable member 12 moves from the first position 301. The direction of arrangement of the engaging parts 161 and the coil springs 162 is not limited to the right-left direction in the drawing as illustrated in FIGS. 1, 8, and 9, and the engaging parts 161 and the coil springs 162 may be arranged in a direction perpendicular to the plane of the drawing.

As described above, the engagement structure of the resistance mechanisms 16 may be modified in various ways. When the engaging parts 161 are regarded as first engaging parts and portions (in the case of FIG. 3, the engaging parts 125) that are engaged with the engaging parts 161 are regarded as second engaging parts, the second engaging parts move relative to the first engaging parts in accordance with the movement of the movable member 12. Then, the engagement of the first engaging parts and the second engaging parts is released when the movable member 12 is pressed toward the holder 11. This produces the minor peak 341 of the load. The first engaging parts and the second engaging parts may be spaced from each other in the first position 301 and once engaged and then disengaged with a press of the movable member 12, or they may already be engaged with each other in the first position 301. By using the engagement of the engaging parts, it is possible to obtain the minor peak 341 with a simple structure.

Note that the first engaging parts do not necessarily have to receive a force from elastic bodies such as springs, and for example the first engaging parts and the second engaging parts may be engaged with each other by gravity or a magnetic force when the movable member 12 is located in the position 321.

When the first engaging parts receive a force from elastic bodies, for example, flat springs or flexible portions of a resin may be used as the elastic bodies other than coil springs. The elastic bodies may use various techniques to exert a force for the engagement between the first engaging parts and the second engaging parts. When expressed in general terms, the elastic bodies are directly or indirectly fixed to either one of the movable member 12 and the holder 11. The second engaging parts are directly or indirectly mounted on the elastic bodies, and the first engaging parts are directly or indirectly fixed to the other of the movable member 12 and the holder 11. Then, with a press of the movable member 12, the second engaging parts move against the force exerted from the elastic bodies to release the engagement. In this way, the minor peak 341 is obtained In the enabling switch 1, the minor peak 341 may be obtained without using any engaging part. For example, a rubber pad that is recessed abruptly by being pressed may be provided between the movable member 12 and the coil springs 121. The minor peak 341 may also be obtained by causing one of a pair of magnets that repel or attract each other to pass through an area located in close proximity to the other magnet.

The enabling switch 1 described above with reference to FIGS. 1 to 9 may be modified in various ways.

Although the enabling switch 1 includes one set of double-pole contacts, two or more sets of double-pole contacts may be provided as described previously. The one set of double-pole contacts including the four terminals may be one single-pole contact including two terminals. The number of single-pole contacts may be one or two or more. The movable member 12 may be a lever that is rotated by being pressed. In the case where the movable member 12 is of a rotary type, the amount of press of the movable member 12 corresponds to the angle of rotation, and the position of the movable member 12 corresponds to a rotational position or the position of a specific portion of the movable member 12.

The characteristics of the enabling switch 1 illustrated in FIG. 2 are applicable to various structures of enabling switches. For example, the characteristics may be applied to the enabling switches disclosed in Japanese Patent Application Laid-Open No. 2002-42606, International Publication No. WO/2002/061779, and Japanese Patent Application Laid-Open No. 2005-56635, which are given by way example as cited documents. As disclosed in these cited documents, various structures may be employed as the contact mechanism 20.

The operation part including the enabling switch 1 is not limited to a teach pendant, and can be used as various operation parts such as operation parts of heavy equipment such as a hoist, operation parts of vehicles, and operation parts of motor-driven wheelchairs.

Figure 10:
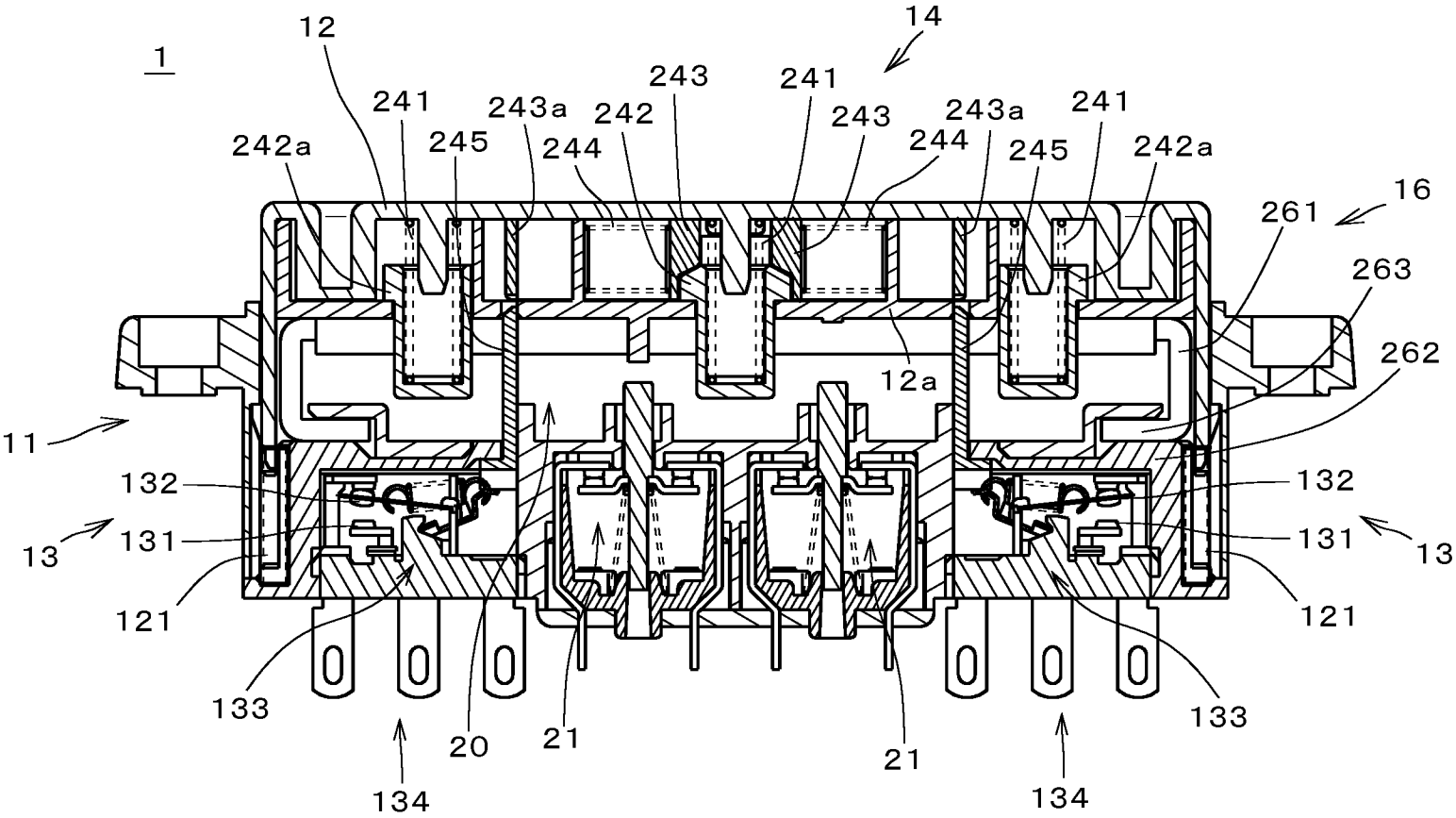
FIG. 10 is a longitudinal sectional view of another enabling switch.
Figure 11:
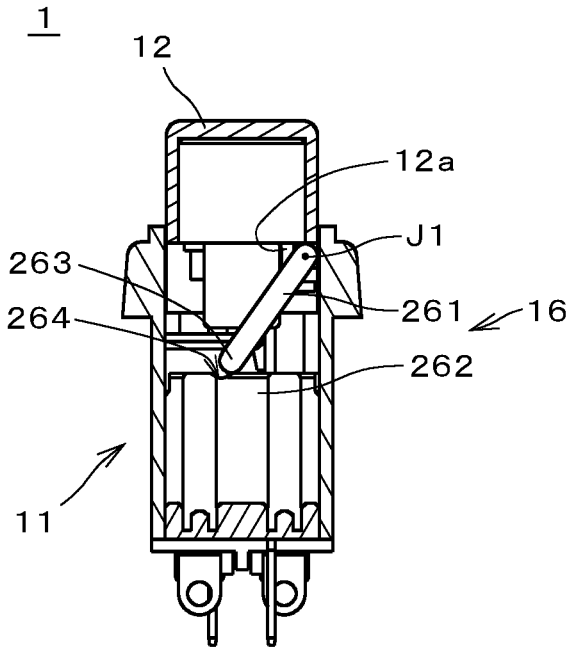
FIG. 11 is a longitudinal sectional view of the enabling switch.

FIGS. 10 and 11 are longitudinal sectional views of an enabling switch 1 provided in an operation part such as a teach pendant of a robot or the controller of a work machine according to another example. Equipment such as a robot or a work machine is an operation target of the operation part. FIG. 10 is a longitudinal sectional view of the enabling switch 1 as viewed from the front, and FIG. 11 is a longitudinal sectional view as viewed from one side. In these sectional views, a section of each member is appropriately taken at a different position in order to facilitate understanding of the internal structure. The enabling switch 1 enables operation of the operation target by the operation part. During the ON state of the enabling switch 1, operation of the operation target is enabled, and when an operator does input to the operation part, a signal based on the input received from the operation part is transmitted to the operation target. During the OFF state of the enabling switch 1, operation of the operation target is disabled, and input from the operator is not transmitted to the operation target.

In FIGS. 10 and 11, details and cross-hatching in sections of members that are not important in the description shall be omitted. In the present embodiment and other embodiments, the same reference signs are assigned to constituent elements that have the same functions as the constituent elements of the enabling switch 1 illustrated in FIGS. 1 to 9. The enabling switch 1 includes a holder 11 and a movable member 12. In the operation of the enabling switch 1, the movable member 12 is pressed downward in FIGS. 10 and 11 into the holder 11 by an operator. The up-down direction in FIGS. 10 and 11 does not necessarily have to match with the direction of gravity. The holder 11 supports members of the enabling switch 1 other than the holder 11. Coil springs 121 in the holder 11 illustrated in FIG. 10 apply a force that is exerted upward in FIG. 10 on the movable member 12 (i.e., in the direction from the holder 11 toward the movable member 12; the same applies to the following description). In FIG. 10, the coil springs 121 and other coil springs are indicated by broken lines in simplified form. When the operator has pressed the movable member 12 into the holder 11 with his or her finger and then moved the finger off the movable member 12, the movable member 12 is returned to its original position by the force of the coil springs 121.

The enabling switch 1 includes, in the holder 11, two contacts 13, a contact mechanism 20 that causes the contacts 13 to transition to an open or closed state, and two auxiliary switches 21. Each contact 13 is a combination of a lower fixed terminal 131 and a movable terminal 132. More correctly, there is also an upper fixed terminal, and connection terminal groups 134 that each include three connection terminals connected respectively to the upper fixed terminal, the lower fixed terminal 131, and the movable terminal 132 are located below the holder 11. In the open state of each contact 13, the lower fixed terminal 131 and the movable terminal 132 are spaced from each other. In the closed state of each contact 13, the lower fixed terminal 131 and the movable terminal 132 are in contact with each other. In the open state of the contacts 13, the enabling switch 1 is in an OFF state, and in the closed state of the contacts 13, the enabling switch 1 is in an ON state.

The movable member 12 is transversely elongated in the right-left direction in FIG. 10 and pressed into the holder 11 in a downward direction perpendicular to the direction of elongation of the movable member 12. Inside the movable member 12, an OFF switching mechanism 14 is arranged. The OFF switching mechanism 14 includes three vertical coil springs 241, an abutment member 242 that houses the vertical coil springs 241, two sliders 243, two horizontal coil springs 244, and two press members 245. In the illustration in FIG. 10, the abutment member 242 is divided into three parts (parts indicated by reference signs 242 and 242*a*) that house the three vertical coil springs 241, but these three parts form a single member. A lower member 12*a* of the movable member 12 has a hole, and the abutment member 242 is fitted in the hole of the lower member 12*a*. The sliders 243 and the horizontal coil springs 244 are arranged in the space between the upper portion of the movable member 12 and the lower member 12*a*.

In the initial state illustrated in FIG. 10, the sliders 243 receive a laterally inward force from the horizontal coil springs 244, the abutment member 242 receives a downward force from the vertical coil springs 241, and the tips of the sliders 243 are located above the abutment member 242. The lower ends of rear end portions 243*a* of the sliders 243 are in close proximity to the upper ends of the press members 245.

The movable terminals 132 are connected to snap mechanisms 133. As will be described later, when the press members 245 are pressed to a predetermined position, the movable terminals 132 are speedily moved toward the lower fixed terminals 131 by springs of the snap mechanisms 133, and the movable terminals 132 and the lower fixed terminals 131 come in contact with each other. That is, the contacts 13 become closed.

As will be described later, the OFF switching mechanism 14 and the snap mechanisms 133 configure the contact mechanism 20 that causes the contacts 13 to transition from an open state to a closed state and further from the closed state to the open state as the movable member 12 is pressed toward the holder 11. The enabling switch 1 includes the two contacts 13, and when these contacts are distinguished respectively as a "first contact 13" and a "second contact 13," the contact mechanism 20 causes the first contact 13 and the second contact 13 to transition from an open state to a closed state and further from the closed state to the open state as the movable member 12 is pressed toward the holder 11. The first contact 13 and the second contact 13 are arranged in the direction of elongation of the movable member 12.

The contact mechanism 20 further includes a resistance mechanism 16 that is provided below the OFF switching mechanism 14. The resistance mechanism 16 includes a rotatable member 261 that is long in the direction of elongation of the movable member 12. The rotatable member 261 is formed by folding down the opposite ends of a metal rod at 90 degrees twice so that the opposite ends face inward. Note that the rotatable member 261 may also be formed by folding down the opposite ends of a metal rod at 90 degrees and then further folding down the opposite ends such that opposite end portions face outward. As illustrated in FIG. 11, the rotatable member 261 is rotatable about a rotation axis J1 that is parallel to the direction of elongation of the rotatable member 261. The opposite ends of the rotatable member 261 are sandwiched between lower members 262 and upper members (see the reference sign 111*a* in FIG. 17). By rotating the rotatable member 261 without the opposite ends of the rotatable member 261 being separated widely from the positioned lower members 262 located therebelow, it is possible to press the laterally long movable member 12 into the holder 11 without a large inclination of the movable member 12.

The rotatable member 261 is rotatably mounted directly on the movable member 12 such that the upper portion of the rotatable member 261 is engaged with the lower member 12*a* of the movable member 12. Part of the members 262 located below the rotatable member 261 is also included in the resistance mechanism 16. The members 262 has recesses 264 in which lower portions 263 of the rotatable member 261 are fitted. In the initial state illustrated in FIGS. 10 and 11, the lower portions 263 of the rotatable member 261 are located outside the recesses 264.

Figure 12:
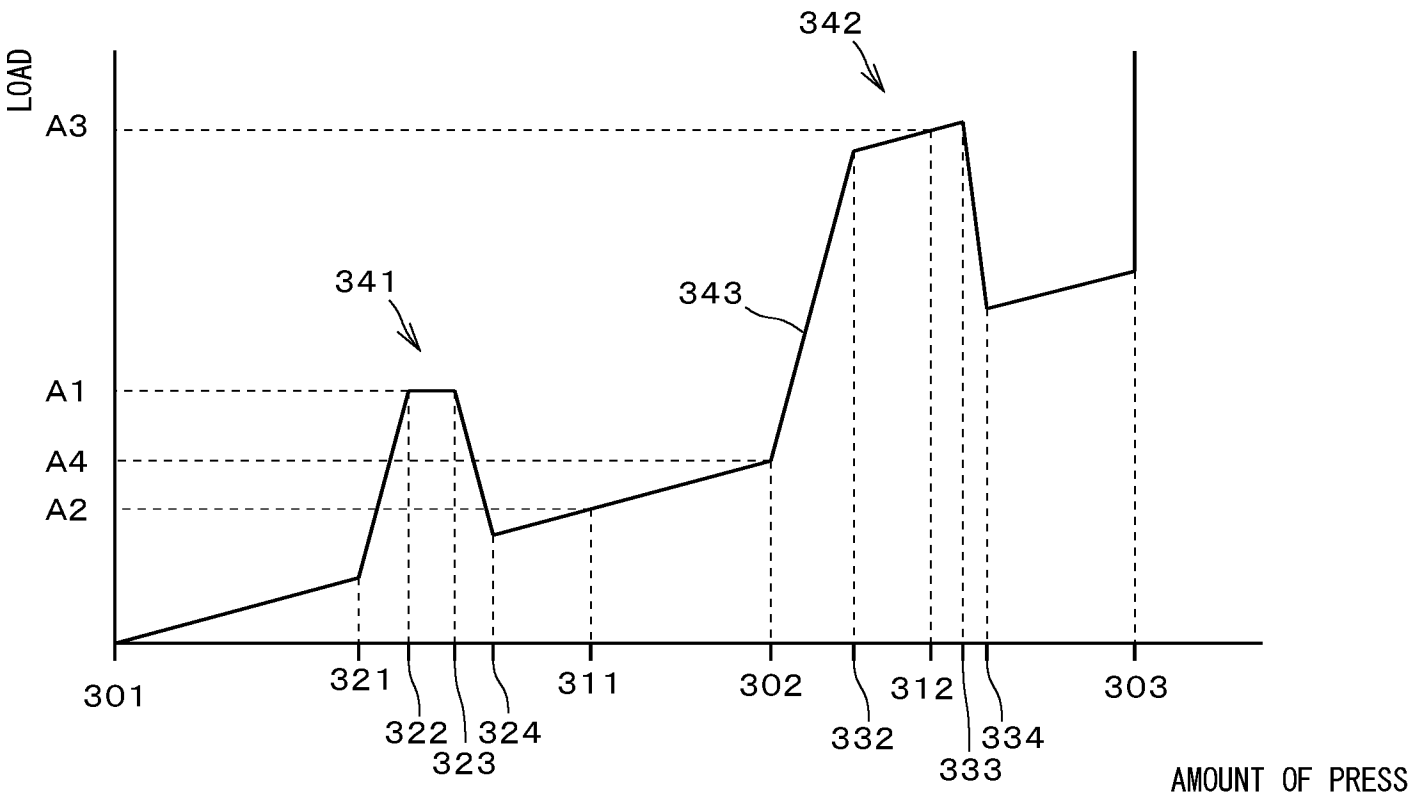
FIG. 12 is a diagram illustrating an outline of the relationship between the load and the amount of press of the enabling switch.

Next is a description of a preferable change in load that is required to press the enabling switch 1 with a press of the movable member 12. FIG. 12 is a diagram illustrating an outline of the relationship between the load and the amount of movement of the movable member 12, i.e., the amount of press of the enabling switch 1. Hereinafter, the position of the movable member 12 corresponding to the amount of press will be described with reference to the reference signs given in FIG. 12.

In FIG. 12, a position 301 is the initial position. Hereinafter, the position 301 is referred to as a "first position." The first position 301 is the position of the movable member 12 relative to the holder 11 in a state in which the movable member 12 is not pressed. A position 303 is the position of the movable member 12 relative to the holder 11 in a state in which the movable member 12 is most pressed. Hereinafter, the position 303 is referred to as a "third position." In the third position 303, the enabling switch 1 is in an OFF state.

A position 302 is the position in which the movable member 12 is pressed to some extent and can be held stably while the operator feels some sort of resistance. Thus, the enabling switch 1 is stably held in an ON state. Hereinafter, the position 302 is referred to as a "second position." The second position 302 is a rising start position of a maximum rise 343 of the load required to press the movable member 12, the rising start positon being between the first position 301 and the third position 303, and the maximum rise being a rise in which the load rises and reaches its maximum in accordance with an increase in the rate of increase of the load relative to the amount of press.

A position 311 is an "ON switching position" in which the contacts 13 transition from an open state to a closed state with a press and the enabling switch 1 transitions from an OFF state to an ON state. A position 312 is an "OFF switching position" in which the contacts 13 transition from the closed state to the open state and the enabling switch 1 transitions from the ON state to the OFF state. Accordingly, in the enabling switch 1, with a press of the movable member 12, the contacts 13 transition from an open state to a closed state in the ON switching position 311 between the first position 301 and the second position 302, and the contacts 13 transition from the closed state to the open state in the OFF switching position 312 between the second position 302 and the third position 303.

More specifically, the enabling switch 1 includes the two contacts 13, and when these contacts are distinguished respectively as a "first contact 13" and a "second contact 13," with a press of the movable member 12, the first contact 13 transitions from an open state to a closed state in a first ON switching position that is between the first position 301 and the second position 302, the first contact 13 transitions from the closed state to the open state in a first OFF switching position that is between the second position 302 and the third position 303, the second contact 13 transitions from an open state to a closed state in a second ON switching position that is between the first position 301 and the second position 302, and the second contact 13 transitions from the closed state to the open state in a second OFF switching position that is between the second position 302 and the third position 303.

In the case of the first contact 13, the position 311 in FIG. 12 corresponds to the first ON switching position, and the position 312 corresponds to the first OFF switching position 312. In the case of the second contact 13, the position 311 corresponds to the second ON switching position, and the position 312 corresponds to the second OFF switching position 312. The first ON switching position and the second ON switching position are the same or in close proximity to each other, and the first OFF switching position and the second OFF switching position are the same or in close proximity to each other.

In the enabling switch 1, a minor peak 341 in which the load once rises and then decreases with a press of the movable member 12 appears between the first position 301 and the second position 302. In FIG. 12, a reference sign 321 is assigned to the position in which the minor peak 341 starts to rise, a reference sign 322 is assigned to the position in which the rising ends and a certain degree of load starts to be maintained, a reference sign 323 is assigned to the position in which the minor peak starts to fall, and a reference sign 324 is assigned to the position in which the falling ends. However, these positions do not necessarily have to appear obviously, and if these positions do not appear obviously, various methods may be used to specify these positions. For example, when the rising start position 321 and the falling end position 324 are on the curve, the positions in which the curvature reaches its maximum may be determined as the positions 321 and 324. The positions 322 and 323 may also be determined in the same manner, and there positions 322 and 323 may be the same. For example, in the case where the minor peak 341 has a sharp top, the positions 322 and 323 are specified as the same position.

As another technique, for example, the position in which a gradient of the load with increasing amount of press exceeds a given positive value may be specified as the rising start position 321, the position in which the gradient falls below the given value may be specified as the rising end position 322, the position in which the gradient falls below a given negative value may be specified as the falling start position 323, and the position in which the gradient exceeds the given value may be specified as the falling end position 324.

Similarly, a rising start position (second position 302), a rising end position 332, a falling start position 333, and a falling end position 334 of a peak between the second position 302 and the third position 303 may be determined using various techniques as long as these positions indicate approximately their respective meaning. The rising end position 332 and the falling start position 333 may be the same. Hereinafter, the peak from the position 302 to the position 334 is referred to as a "major peak 342."

In the enabling switch 1 illustrated in FIGS. 10 and 11, the ON switching position 311 (more specifically, the first ON switching position and the second ON switching position; the same applies to the following description) is between the falling end position 324 of the minor peak 341 and the second position 302. A maximum load A1 during the minor peak is greater than or equal to a load A2 in the ON switching position 311 (more specifically, a greater one of the load in the first ON switching position and the load in the second ON switching position) and less than a load A3 in the OFF switching position 312 (more specifically, a smaller one of the load in the first OFF switching position and the load in the second OFF switching position).

Accordingly, when the movable member 12 starts to be pressed, the movable member 12 is pressed abruptly after a slightly resistive tactile click feel and transitions to the second position 302. That is, during normal operation, the movable member 12 cannot be stopped partway after the minor peak 341 and speedily transitions to the second position 302 with a feel that the movable member 12 strikes something. As a result, the operator is able to clearly feel that the movable member 12 has reached the second position 302. In other words, the operator is able to clearly feel an increase in load relative to the amount of press at a stage before the switch is further pressed from the ON state in the second position 302 and transitions to the OFF state in the third position 303.

From the above-described viewpoint, the ON switching position 311 is not limited to the position illustrated in FIG. 12. The ON switching position 311 may be any position between the falling start position 323 of the minor peak 341 and the second position 302. From the viewpoint of causing the movable member 12 to speedily transition from the minor peak 341 to the second position 302, the maximum load A1 during the minor peak 341 is preferably greater than a load A4 in the second position 302. Moreover, in order to prevent the switch that has passed the minor peak 341 from transitioning to the OFF state beyond the second position 302, the maximum load during the minor peak 341 is preferably less than the load in a position immediately before the OFF switching position 312 (more specifically, the loads in positions immediately before the first OFF switching position and the second OFF switching position; in general, the load in the position 332).

The rising start position 321 of the minor peak 341 may be almost or exactly the same as the first position 301. Even in this case, the operator is able to receive a resistive feel when the movable member 12 is pressed. In particular, when the minor peak 341 rises almost vertically, i.e., when the positions 321 and 322 are almost the same, the operator is able to more clearly receive a resistive feel. Of course, even if the rising start position 321 of the minor peak 341 is apart from the first position 301, it is preferable that the minor peak 341 raises almost vertically.

Moreover, in order for the operator to clearly feel the transition to the second position 302 after having received a resistive feel with a press of the movable member 12, it is preferable that the minor peak 341 and the second position 302 are apart enough from each other. Specifically, the position of the maximum load during the minor peak 341 is preferably closer to the first position 301 than to a midpoint position between the first position 301 and the second position 302. This is because, if the minor peak 341 is close to the second position 302, the minor peak 341 may be misdetected as the major peak 342.

In the enabling switch 1 having the characteristics illustrated in FIG. 12, even with the provision of the minor peak 341, there is no need to change a design load necessary to hold the movable member 12 in the second position 302. Thus, even if the operation part including the enabling switch 1 has been grasped in the second position 302 for a long time, strain will not be imposed on the operator. Moreover, the provision of the minor peak 341 brings about the effect of preventing the enabling switch 1 from unintentionally transitioning to an ON state in cases such as where the movable member 12 is touched by mistake or where the movable member 12 comes in contact with other objects.

Although the change in load from the falling of the minor peak 341 to the second position 302 is indicated by the straight line in FIG. 12, the change is not limited to a change indicated by the straight line as long as there are no large changes. For example, the rate of change in load may be changed in the ON switching position 311 and the load curve may be bent, or the load may slightly change stepwise in the ON switching position 311.

Next is a description of how the enabling switch 1 illustrated in FIGS. 10 and 11 achieves the characteristics illustrated in FIG. 12.

Figure 13:
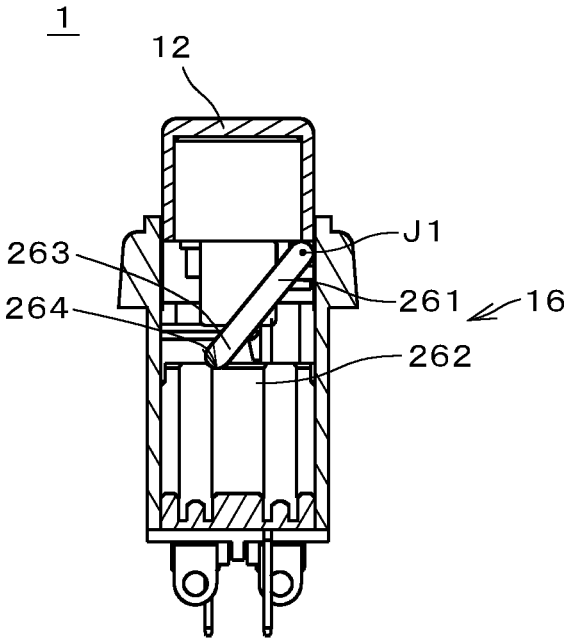
FIG. 13 is a longitudinal sectional view of the enabling switch.

When the movable member 12 starts to be pressed from the first position 301, the coil springs 121 are compressed, and as illustrated in FIG. 13, the lower portions 263 of the rotatable member 261 slide over the upper faces of the members 262. Hereinafter, the lower portions 263 of the rotatable member 261 are referred to as "rotatable sliding contact parts," and the members 262 are referred to as "fixed sliding contact parts." When the rotatable member 261 slightly rotates about the rotation axis J1, the rotatable sliding contact parts 263 are fitted in and engaged with the recesses 264. This increases the load that presses the movable member 12. The position of the movable member 12 illustrated in FIG. 13 is the rising start position 321 of the minor peak 341. As illustrated in FIG. 11, the rotatable sliding contact parts 263 and the recesses 264 are slightly spaced from each other in the first position 301, and the first position 301 is close to the position 321.

Figure 14:
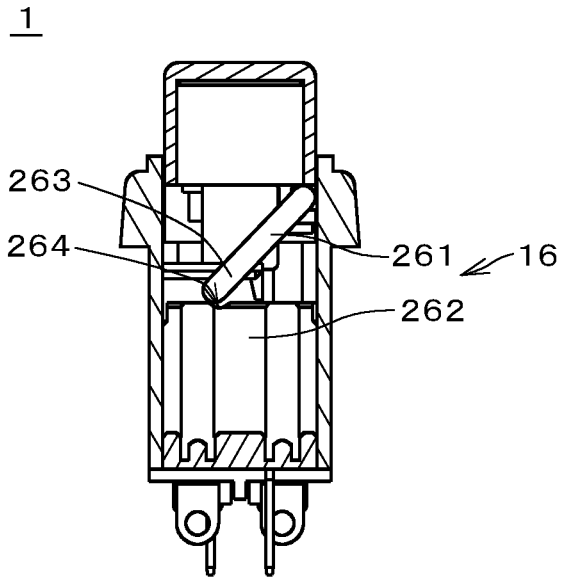
FIG. 14 is a longitudinal sectional view of the enabling switch.

If the load applied to the movable member 12 increases, the rotatable sliding contact parts 263 start to move in a direction away from the recesses 264 as illustrated in FIG. 14. This state is the state of transition from the position 321 to the position 322.

Figure 15:
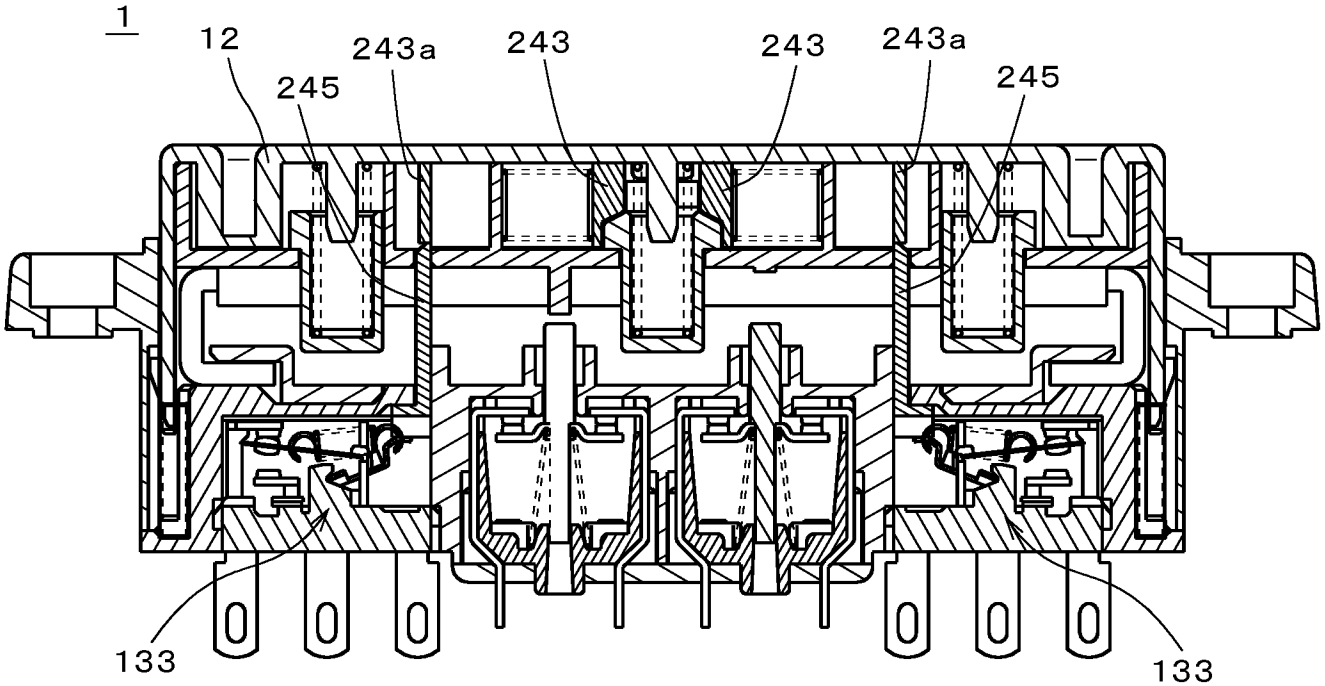
FIG. 15 is a longitudinal sectional view of the enabling switch.
Figure 16:
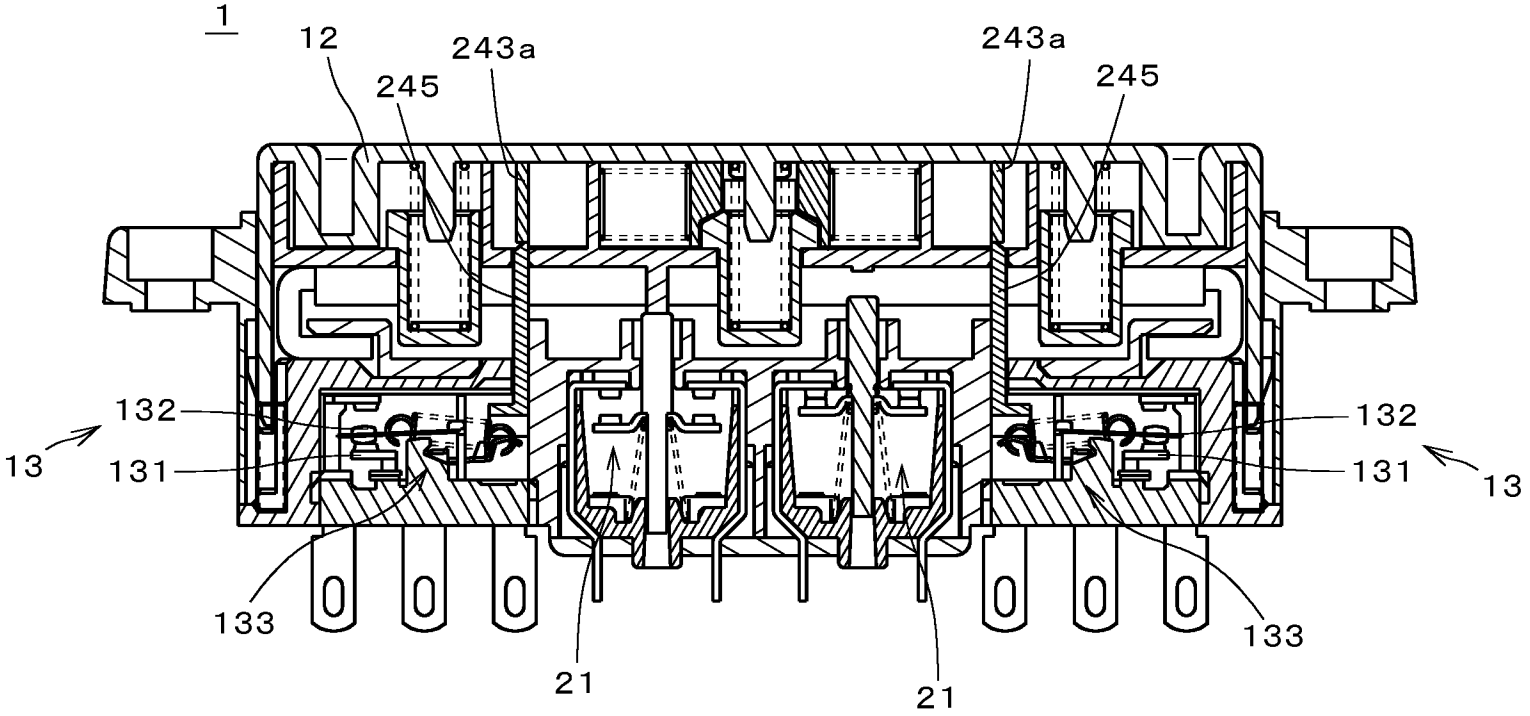
FIG. 16 is a longitudinal sectional view of the enabling switch when a movable member is located in an ON switching position.

When the rotatable sliding contact parts 263 have come off the recesses 264, the load decreases abruptly. That is, the movable member speedily reaches the position 324 from the position 323. In the case of the enabling switch 1 illustrated in FIGS. 10 and 11, the positions 323 and 324 are almost the same. In the enabling switch 1, almost simultaneously with or immediately after the decrease in load, the rear end portions 243*a* of the sliders 243 and the upper ends of the press members 245 come in contact with each other as illustrated in FIG. 15. The press members 245 also move downward with the downward movement of the movable member 12 and press specific portions of the snap mechanisms 133. When the press members 245 have been moved down to a predetermined position as illustrated in FIG. 16, the movable terminals 132 are instantaneously moved down by snap action of the snap mechanisms 133, and the contacts 13 transition to a closed state.

Figure 17:
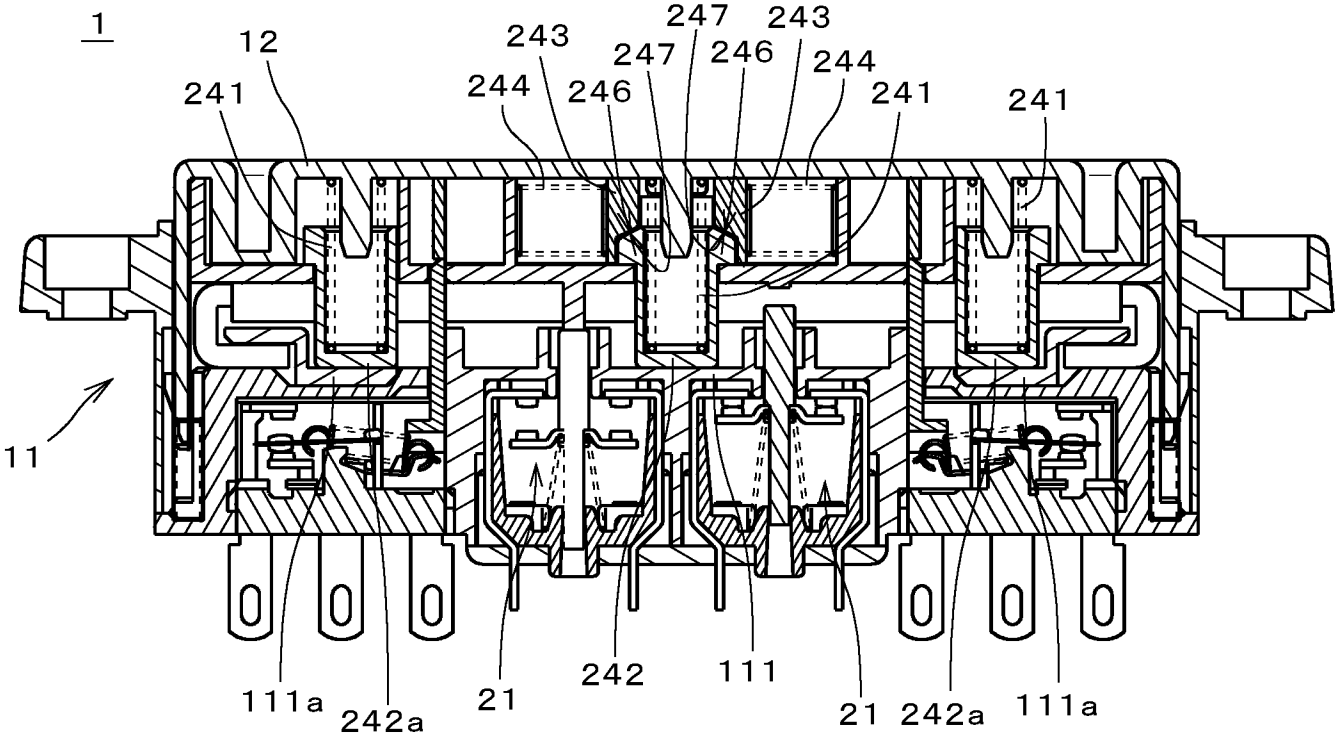
FIG. 17 is a longitudinal sectional view of the enabling switch when the movable member is located in a second position.

When the movable member 12 has further moved downward, the lower end of the abutment member 242 comes in contact with the upper face of a base member 111, which is one part of the holder 11, as illustrated in FIG. 17. Note that the portions of the abutment member 242 indicated by the reference sign 242*a* come in contact with portions of the base member 111 indicated by a reference sign 111*a*. The position of the movable member 12 illustrated in FIG. 17 is the second position 302.

When a downward force is applied to the movable member 12 in the state illustrated in FIG. 17, an upward force relative to the movable member 12 is exerted on the abutment member 242. The upper face of a central portion of the abutment member 242 includes inclined faces 246 that are inclined downward toward the outside in the lateral direction. On the other hand, the lower faces of the tips of the sliders 243 include inclined faces 247 that are inclined upward toward the inside in the lateral direction. The inclined faces 246 and the inclined faces 247 are almost in parallel contact with each other.

Thus, when the load applied to the movable member 12 is increased so that an upward force is exerted from the abutment member 242 on the sliders 243, the sliders 243 start to move outward in the lateral direction against the force exerted from the horizontal coil springs 244. At this time, the vertical coil springs 241 shrink. This state is the state of transition from the position 302 to the position 333 via the position 332.

When the edges of the inclined faces 246 have matched with the edges of the inclined faces 247, the movable member 12 moves downward such that the outer side faces of the upper end of the central positon of the abutment member 242 are rubbing against the tips of the sliders 243. At this time, the load decreases abruptly. Accordingly, the movable member speedily reaches the position 334 from the position 333. In the case of the enabling switch 1 illustrated in FIGS. 10 and 11, the positions 333 and 334 are almost the same. Through the operation described above, the major peak 342 is obtained.

Figure 18:
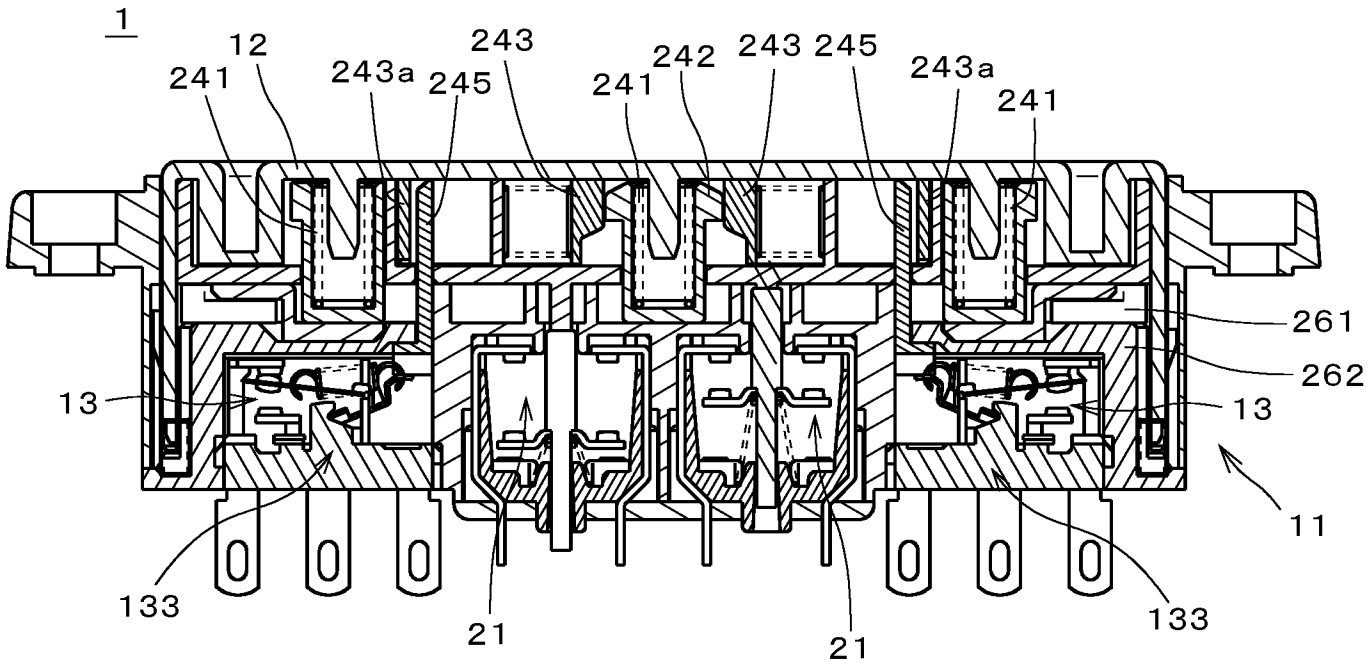
FIG. 18 is a longitudinal sectional view of the enabling switch when the movable member is located in a third position.
Figure 19:
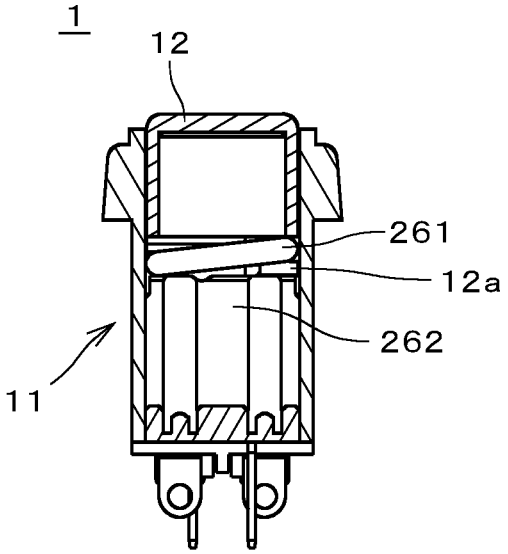
FIG. 19 is a longitudinal sectional view of the enabling switch when the movable member is located in the third position.

FIGS. 18 and 19 are diagrams illustrating a state in which the movable member 12 is most pressed. When the sliders 243 move outward in the lateral direction in the OFF switching position 312 before the state illustrated in FIGS. 18 and 19, the abutment of the rear end portions 243*a* of the sliders 243 and the press members 245 in the up-down direction is released. As a result, the press members 245 move upward under the force received from the snap mechanisms 133, and the contacts 13 transition from the closed state to the open state.

As illustrated in FIG. 18, when the movable member 12 is most pressed, the vertical coil springs 241 are further compressed, and as illustrated in FIG. 19, the lower member 12*a* of the movable member 12 is brought into close proximity to the fixed sliding contact parts 262 and into contact with the base member 111 (see FIG. 17). This state corresponds to the third position 303, and downward movement of the movable member 12 is disabled. As illustrated in FIG. 19, the rotatable member 261 is located in a narrow space between the movable member 12 and the fixed sliding contact parts 262 of the holder 11.

When the operator has moved his or her finger off the enabling switch 1 in the state illustrated in FIGS. 18 and 19, the movable member 12 moves upward while maintaining a state in which the rear end portions 243*a* of the sliders 243 and the press members 245 deviate from each other in the lateral direction. When the sliders 243 are located above the upper ends of the press members 245, the rear end portions 243*a* of the sliders 243 are located immediately above the press members 24 under the force received from the horizontal coil springs 244 as illustrated in FIG. 10. Accordingly, the contacts 13 are maintained in the open state until the movable member 12 returns to the first position 301 in FIG. 10. When the movable member 12 is returning from the third position 303, the enabling switch 1 is maintained in the OFF state. That is, when the operator has moved his or her finger off the movable member 12 from the second position 302, the movable member 12 returns to the first position 301, and the enabling switch 1 returns to the OFF state.

In the state illustrated in FIG. 10, the two auxiliary switches 21 are both in an ON state. In the states illustrated in FIGS. 16 and 17, either one of the two auxiliary switches is in an ON state. In the state illustrated in FIG. 18, both of the two auxiliary switches are in an OFF state. Signals received from the auxiliary switches 21 are used in various ways on the operation part side. For example, if both of the auxiliary switches 21 are in the ON state in the OFF state of the enabling switch 1, the operation part determines that the enabling switch 1 is in the first position 301. If both of the auxiliary switches 21 are in the OFF state in the OFF state of the enabling switch 1, the operation part determines that the enabling switch 1 is in the third position 303.

As described above, in the enabling switch 1, the presence of the minor peak 341 prevents operation from being stopped partway in any position between the minor peak 341 and the second position 302 during normal operation and enables the operator to clearly feel that the movable member 12 has reached the second position 302. In the case where the two contacts 13 are provided in order to improve reliability as in the enabling switch 1, even if the movable member 12 is inclined, it is possible, by making a speedy transition from the minor peak 341 to the second position 302, to considerably shorten the duration of time that the two contacts 13 remain in different states. That is, the difference in switching timing between the two contacts 13 can be reduced. As a result, it is possible to prevent misdetection of an error caused by the fact that the two contacts 13 remain in different states for a given period of time or more.

The difference in operation timing between the two contacts 13 appears markedly when the edge of the movable member 12 is pressed and accordingly the movable member 12 is inclined. Thus, it is conceivable that the minor peak 341 does not necessarily have to be present when the center of the movable member 12 is pressed. As described above, in the enabling switch 1, the minor peak 341 of the load is obtained by engaging the rotatable sliding contact parts 263 of the rotatable member 261 with the recesses 264 of the fixed sliding contact parts 262. The rotatable sliding contact parts 263 are present only in the opposite end portions of the rotatable member 261 in the longitudinal direction.

In view of this, a configuration is also possible in which the recesses 264 are made considerably shallow so that when the center of the movable part 261 is pressed, the rotatable sliding contact parts 263 move to slide over the recesses 264, and when the edge of the rotatable member 261 is pressed, the rotatable sliding contact parts 263 existing at the ends of the rotatable member 261 are strongly fitted into the recesses 264 so as to obtain the minor peak 341 of the load. In this way, it is possible to eliminate the minor peak 341 or obtain only a small minor peak 341 when the center of the rotatable member 261 is pressed and to obtain a large minor peak 341 when the edge of the rotatable member 261 is pressed.

The resistance mechanism 16 in the enabling switch 1 may be modified in various ways. For example, the rotation axis J1 of the rotatable member 261 may be provided in close proximity to the fixed sliding contact parts 262, and the lower member 12*a* may have recesses. That is, the rotatable member 261 may be rotated about its lower portion. Instead of the recesses, protrusions (including steps) may be provided. The rotatable member 261 may be rotatably mounted directly or indirectly on either one of the movable member 12 and the holder 11, and the fixed sliding contact parts 262 may be directly or indirectly fixed to the other of the movable member 12 and the holder 11. By rotating the rotatable member 261 such that the rotatable sliding contact parts 263 and the fixed sliding contact parts 262 are in sliding contact with each other, it is possible to press the movable member 12 into the holder 11 while maintaining the posture of the movable member 12.

The resistance mechanism 16 may have a structure other than the rotatable member 261. For example, the resistance mechanism 16 may include engaging parts and coil springs arranged between the holder 11 and the engaging parts. In this case, the minor peak 341 is obtained by engaging the engaging parts, which receive a force from the coil springs, with the movable member 12 and pressing the movable member 12 to move the engaging parts against the force exerted from the coil springs and to release the engagement. The resistance mechanism 16 may include engaging parts and coil springs that are arranged between the movable member 12 and the engaging parts. In this case, the minor peak 341 is obtained by engaging the engaging parts, which receive a force from the coil springs, with the holder 11 and then pressing the movable member 12 to release the engagement. It is of course possible to provide the resistance mechanism 16 indirectly between the holder 11 and the movable member 12.

As described above, the engagement structure of the resistance mechanism 16 may be modified in various ways. When one engaging parts (in the case of FIG. 11, recesses 264) are regarded as first engaging parts and the other engaging parts (in the case of FIG. 11, rotatable sliding contact parts 263) that are engaged with the first engaging parts are regarded as second engaging parts, the second engaging parts move relative to the first engaging parts in accordance with the movement of the movable member 12. Then, the engagement of the first engaging parts and the second engaging parts is released when the movable member 12 is pressed toward the holder 11. This produces the minor peak 341 of the load. The first engaging parts and the second engaging parts may be spaced from each other in the first position 301 and once engaged and then disengaged with a press of the movable member 12, or they may already be engaged with each other in the first position 301. By using the engagement of the engaging parts, it is possible to obtain the minor peak 341 with a simple structure.

Note that the first engaging parts do not necessarily have to receive a force from elastic bodies such as springs. As illustrated by way of example in FIGS. 10 and 11, the first engaging parts and the second engaging parts may be engaged with each other by gravity when the movable member 12 is located in the position 321. A magnetic force may be used for the engagement.

When the first engaging parts receive a force from elastic bodies, for example, flat springs or flexible portions of a resin may be used as the elastic bodies other than coil springs. The elastic bodies may use various techniques to exert a force for the engagement between the first engaging parts and the second engaging parts. When expressed in general terms, the elastic bodies are directly or indirectly fixed to either one of the movable member 12 and the holder 11. The second engaging parts are directly or indirectly mounted on the elastic bodies, and the first engaging parts are directly or indirectly fixed to the other of the movable member 12 and the holder 11. Then, with a press of the movable member 12, the second engaging parts move against the force exerted from the elastic bodies to release the engagement. In this way, the minor peak 341 is obtained.

In the enabling switch 1, the minor peak 341 may be obtained without using any engaging part. For example, a rubber pad that is recessed abruptly by being pressed may be provided between the movable member 12 and the coil springs 121. The minor peak 341 may also be obtained by causing one of a pair of magnets that repel or attract each other to pass through an area located in close proximity to the other magnet.

The enabling switch 1 described above with reference to FIGS. 10 to 19 may be modified in various ways.

In the enabling switch 1, the number of contacts may be three or more. The movable member 12 may be a lever that is rotated by being pressed. In the case where the movable member 12 is of a rotary type, the amount of press of the movable member 12 corresponds to the angle of rotation.

The characteristics of the enabling switch 1 illustrated in FIG. 12 are applicable to various structures of enabling switches. For example, the characteristics may be applied to the enabling switches disclosed in Japanese Patent Application Laid-Open No. 2001-35300, International Publication No. WO/2002/061779, and Japanese Patent Application Laid-Open No. 2005-56635, which are given by way of example as cited documents. As disclosed in these cited documents, various structures may be employed as the contact mechanism 20.

While the above-described enabling switch 1 uses snap action to open and close the contacts 13, the enabling switch 1 may close the contacts by causing the two terminals included in each contact 13 to gradually approach and come into contact with each other as the movable member 12 is pressed in close proximity to the ON switching position 311 toward the holder 11. In this case, it is possible, by making a speedy transition from the minor peak 341 to the second position 302, to suppress discharge occurring when the contacts 13 become closed and to suppress welding of the contacts 13.

The operation part including the enabling switch 1 is not limited to a teach pendant, and can be used as various operation parts such as operation parts of heavy equipment such as a hoist, operation parts of vehicles, and operation parts of motor-driven wheelchairs.

Figure 20:
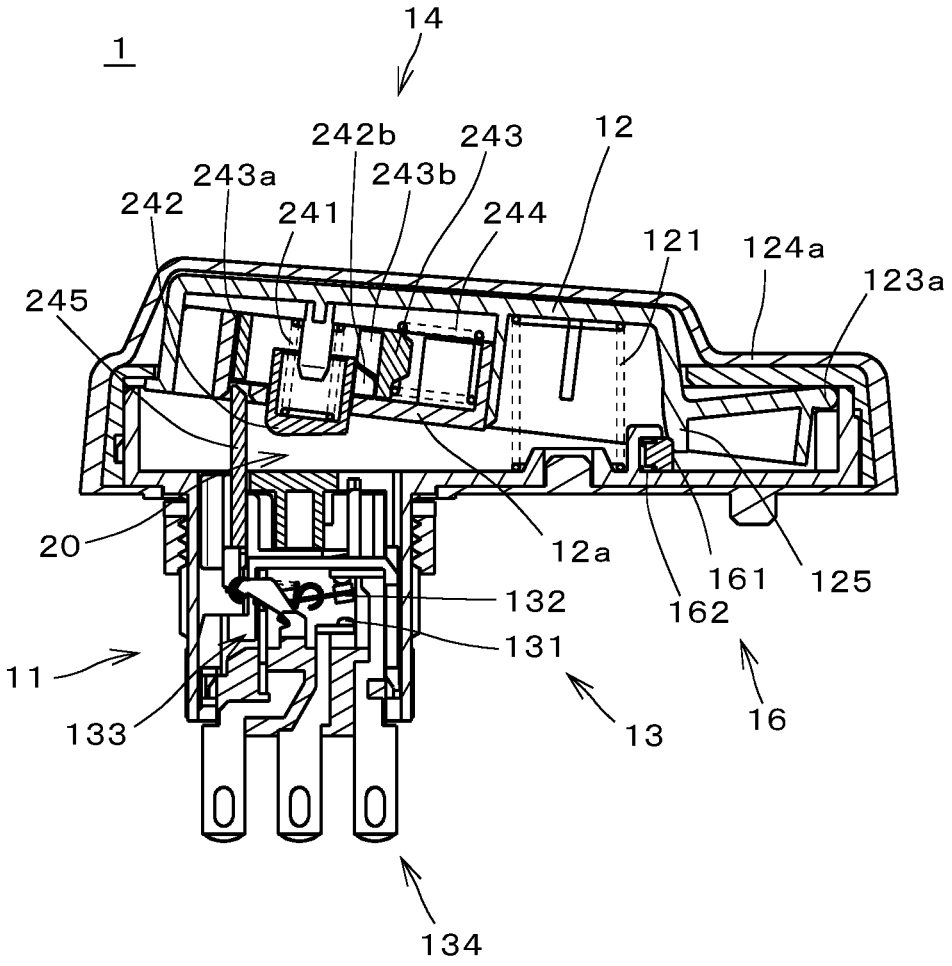
FIG. 20 is a longitudinal sectional view of another enabling switch.
Figure 21:
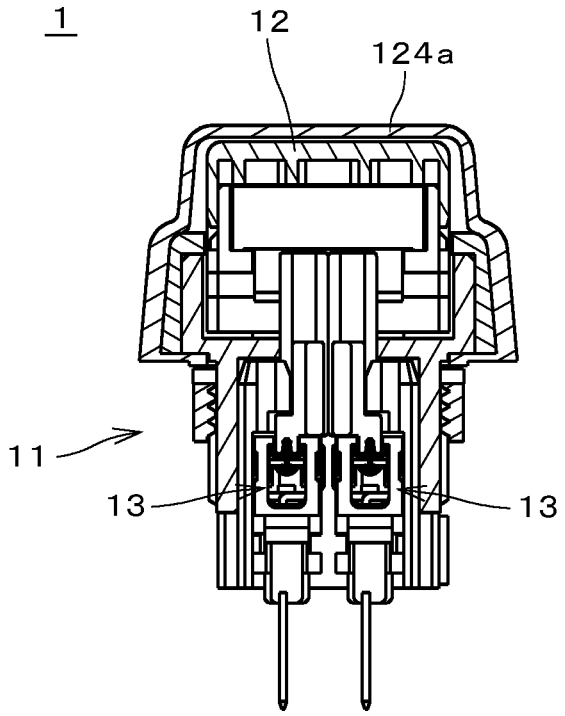
FIG. 21 is a longitudinal sectional view of the enabling switch.

FIGS. 20 and 21 are longitudinal sectional views of an enabling switch 1 provided in an operation part such as a teach pendant of a robot or the controller of a work machine according to yet another example. Equipment such as a robot or a work machine is an operation target of the operation part. FIG. 20 is a longitudinal sectional view of the enabling switch 1 as viewed from the front, and FIG. 21 is a longitudinal sectional view of the enabling switch 1 as viewed from one side. In these sectional views, a section of each member is appropriately taken at a different position in order to facilitate understanding of the internal structure. The same applies to enabling switches according to the following other examples. The enabling switch 1 enables operation of the operation target by the operation part. During the ON state of the enabling switch 1, operation of the operation target is enabled, and when an operator does input to the operation part, a signal based on the input received from the operation part is transmitted to the operation target. During the OFF state of the enabling switch 1, operation of the operation target is disabled, and input from the operator is not transmitted to the operation target.

In FIGS. 20 and 21, details and cross-hatching in sections of members that are not important in the description shall be omitted. The same applies to the enabling switches according to the following other examples. The enabling switch 1 includes a holder 11 and a movable member 12. In the operation of the enabling switch 1, the movable member 12 is pressed downward in FIGS. 20 and 21 into the holder 11 by the operator. The up-down direction in FIGS. 20 and 21 does not necessarily have to match with the direction of gravity. The holder 11 supports members of the enabling switch 1 other than the holder 11. A coil spring 121 in the holder 11 illustrated in FIG. 20 applies a force that is exerted upward in FIG. 20 on the movable member 12. In FIG. 20, the coil spring 121 and other coil springs are indicated by broken lines in simplified form. When the operator has pressed the movable member 12 into the holder 11 with his or her finger and then moved the finger off the movable member 12, the movable member 12 is returned to its original position by the force of the coil spring 121. When the movable member 12 is pressed into the holder 11, the movable member 12 rotates about a fulcrum 123*a*.

The enabling switch 1 includes, in the holder 11, two contacts 13 (see FIG. 21) and a contact mechanism 20 that causes the contacts 13 to transition to an open or closed state. Each contact 13 is a combination of a lower fixed terminal 131 and a movable terminal 132. More specifically, there is also an upper fixed terminal, and connection terminal groups 134 that each include three connection terminals connected respectively to the upper fixed terminal, the lower fixed terminal 131, and the movable terminal 132 are located below the holder 11. In the open state of each contact 13, the lower fixed terminal 131 and the movable terminal 132 are spaced from each other. In the closed state of each contact 13, the lower fixed terminal 131 and the movable terminal 132 are in contact with each other. In the open state of the contacts 13, the enabling switch 1 is in an OFF state, and in the closed state of the contacts 13, the enabling switch 1 is in an ON state.

The movable member 12 is covered with a soft resin cover 124*a*. The movable member 12 is pressed from above the cover 124*a*. Thus, the cover 124*a* is supposed to bend during the press of the movable member 12, but in the following drawings, such a bend of the cover 124*a* shall be ignored. Inside the movable member 12, an OFF switching mechanism 14 is arranged. The OFF switching mechanism 14 includes a vertical coil spring 241, an abutment member 242 that houses the vertical coil spring 241, a slider 243, a horizontal coil spring 244, and a press member 245. A lower member 12*a* of the movable member 12 has a hole, and the abutment member 242 is fitted in the hole of the lower member 12*a*. The slider 243 and the horizontal coil spring 244 are arranged in the space between the upper portion of the movable member 12 and the lower member 12*a*.

In the initial state illustrated in FIG. 20, the slider 243 receives a leftward force from the horizontal coil spring 244, the abutment member 242 receives a downward force from the vertical coil spring 241, and a left-side portion 243*b* of a right-side tip portion of the slider 243 is located above a right-side portion 242*b* of the abutment member 242. The lower end of a rear end portion 243*a* of the slider 243 is in close proximity to the upper end of the press member 245.

The movable terminal 132 is connected to a snap mechanism 133. As will be described later, when the press member 245 is pressed to a predetermined position, the movable terminal 132 is speedily moved toward the lower fixed terminal 131 by a spring of the snap mechanism 133, and the movable terminal 132 and the lower fixed terminal 131 come in contact with each other. That is, the contact 13 becomes closed.

As will be described later, the OFF switching mechanism 14 and the snap mechanism 133 configure the contact mechanism 20 that causes the contacts 13 to transition from an open state to a closed state and further from the closed state to the open state as the movable member 12 is pressed toward the holder 11. The enabling switch 1 includes the two contacts 13, and when these contacts are distinguished respectively as a "first contact 13" and a "second contact 13," the contact mechanism 20 causes the first contact 13 and the second contact 13 to transition from an open state to a closed state and further from the closed state to the open state as the movable member 12 is pressed toward the holder 11.

The contact mechanism 20 further includes a resistance mechanism 16 that is provided in close proximity to the coil spring 121. The resistance mechanism 16 is provided in a hole of the holder 11 that is open in the right direction in FIG. 20. The resistance mechanism 16 includes an engaging part 161 and a coil spring 162. More specifically, a portion of the holder 11 that is located in close proximity to the engaging part 161 and the coil spring 162 also forms part of the resistance mechanism 16. The coil spring 162 presses the engaging part 161 in the right direction in FIG. 20, i.e., toward a lower portion 125 of the inner wall of the movable member 12. In the initial state illustrated in FIG. 20, a tip portion of the engaging part 161 is in contact with the lower portion 125 of the inner wall. As will be described later, the resistance mechanism 16 exerts a force resistant to the movement of the movable member 12 on the movable member 12 at an initial stage of press of the movable member 12.

Figure 22:
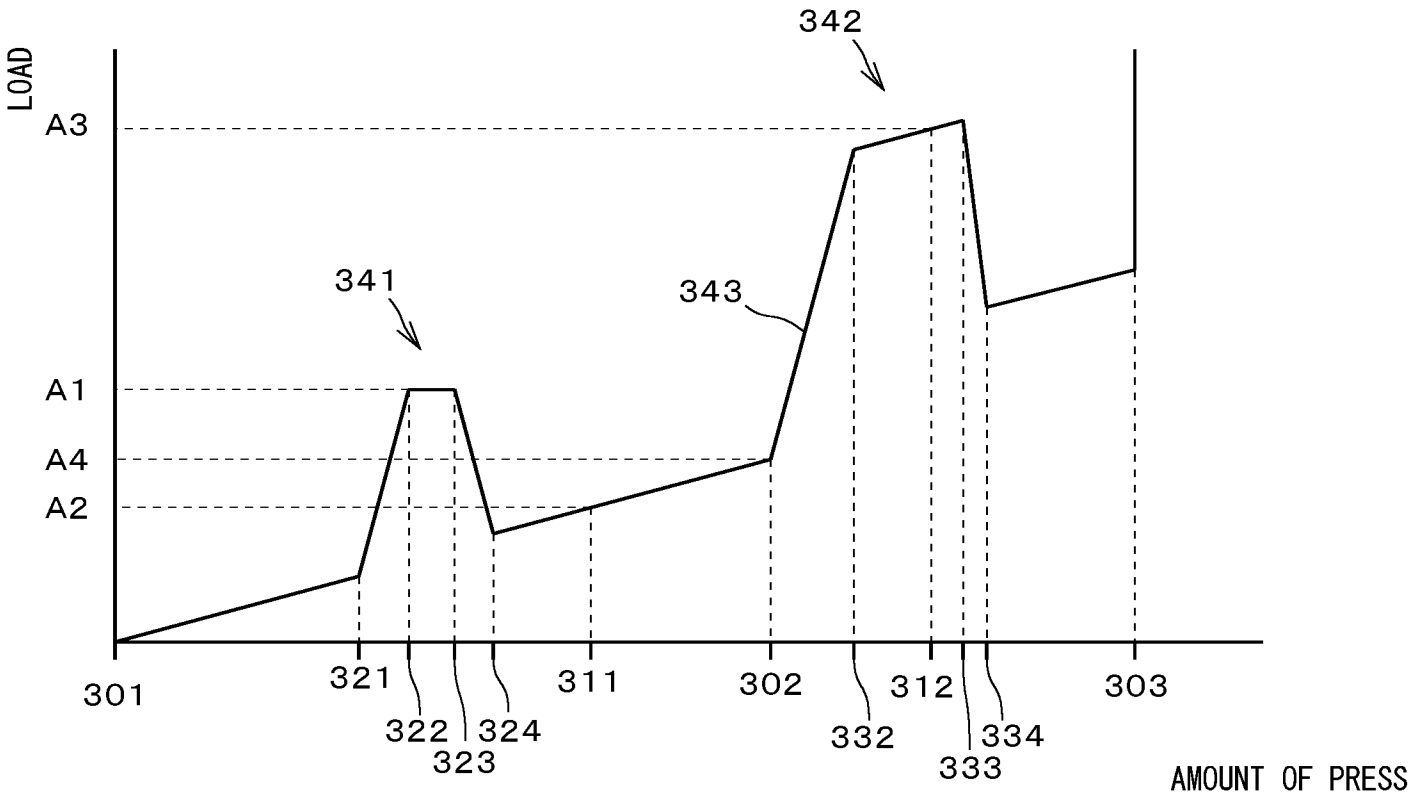
FIG. 22 is a diagram illustrating an outline of the relationship between the load and the amount of press of the enabling switch.

Next is a description of a preferable change in load, i.e., a force required to press the enabling switch 1 with a press of the movable member 12. FIG. 22 is a diagram illustrating an outline of the relationship between the load and the rotational position of the movable member 12, i.e., the amount of press of the enabling switch 1 or the amount of movement of a specific portion of the movable member 12. Hereinafter, the position of the movable member 12 corresponding to the amount of press will be described with reference to the reference signs given in FIG. 22.

In FIG. 22, a position 301 is the initial position. Hereinafter, the position 301 is referred to as a "first position." The first position 301 is the position of the movable member 12 relative to the holder 11 in a state in which the movable member 12 is not pressed. A position 303 is the position of the movable member 12 relative to the holder 11 in a state in which the movable member 12 is most pressed. Hereinafter, the position 303 is referred to as a "third position." In the third position 303, the enabling switch 1 is in an OFF state.

A position 302 is the position in which the movable member 12 is pressed to some extent and can be stably held while the operator feels some sort of resistance. Thus, the enabling switch 1 is stably held in an ON state. Hereinafter, the position 302 is referred to as a "second position." The second position 302 is a rising start position of a maximum rise 343 of the load required to press the movable member 12, the rising start position being between the first position 301 and the third position 303, and the maximum rise being a rise in which the load rises and reaches its maximum in accordance with an increase in the rate of increase of the load relative to the amount of press.

A position 311 is an "ON switching position" in which the contacts 13 transition from an open state to a closed state with a press and the enabling switch 1 transitions from an OFF state to an ON state. A position 312 is an "OFF switching position" in which the contacts 13 transition from the closed state to the open state and the enabling switch 1 transitions from the ON state to the OFF state. Accordingly, in the enabling switch 1, with a press of the movable member 12, the contacts 13 transition from an open state to a closed state in the ON switching position 311 between the first position 301 and the second position 302, and the contacts 13 transition from the closed state to the open state in the OFF switching position 312 between the second position 302 and the third position 303.

More specifically, the enabling switch 1 includes the two contacts 13, and when these contacts are distinguished respectively as a "first contact 13" and a "second contact 13," with a press of the movable member 12, the first contact 13 transitions from an open state to a closed state in a first ON switching position that is between the first position 301 and the second position 302, the first contact 13 transitions from the closed state to the open state in a first OFF switching position that is between the second position 302 and the third position 303, the second contact 13 transitions from an open state to a closed state in a second ON switching position that is between the first position 301 and the second position 302, and the second contact 13 transitions from the closed state to the open state in a second OFF switching position that is between the second position 302 and the third position 303.

In the case of the first contact 13, the position 311 in FIG. 22 corresponds to the first ON switching position, and the position 312 corresponds to the first OFF switching position 312. In the case of the second contact 13, the position 311 corresponds to the second ON switching position, and the position 312 corresponds to the second OFF switching position 312. The first ON switching position and the second ON switching position are the same or in close proximity to each other, and the first OFF switching position and the second OFF switching position are the same or in close proximity to each other.

In the enabling switch 1, a minor peak 341 in which the load once rises and then decreases with a press of the movable member 12 appears between the first position 301 and the second position 302. In FIG. 22, a reference sign 321 is assigned to the position in which the minor peak 341 starts to rise, a reference sign 322 is assigned to the position in which the rising ends and a certain degree of load starts to be maintained, a reference sign 323 is assigned to the position in which the minor peak starts to fall, and a reference sign 324 is assigned to the position in which the falling ends. However, these positions do not necessarily have to appear obviously, and if these positions do not appear obviously, various methods may be used to specify these positions. For example, when the rising start position 321 and the falling end position 324 are on the curve, the positions in which the curvature reaches its maximum may be specified as the positions 321 and 324. The positions 322 and 323 may also be determined in the same manner, and these positions 322 and 323 may be the same. For example, in the case where the minor peak 341 has a sharp top, the positions 322 and 323 are specified as the same position.

As another technique, for example, the position in which a gradient of the load with increasing amount of press exceeds a given positive value may be specified as the rising start position 321, the position in which the gradient falls below the given value, au be specified as the rising end position 322, the position in which the gradient falls below a given negative value may be specified as the falling start position 323, and the position in which the gradient exceeds the given value may be specified as the falling end position 324.

Similarly, a rising start position (second position 302), a rising end position 332, a falling start position 333, and a falling end position 334 of a peak between the second position 302 and the third position 303 may be determined using various techniques as long as these positions indicate approximately their respective meaning. The rising end position 332 and the falling start position 333 may be the same. Hereinafter, the peak from the position 302 to the position 334 is referred to as a "major peak 342."

In the enabling switch 1 illustrated in FIGS. 20 and 21, the ON switching position 311 (more specifically, the first ON switching position and the second ON switching position; the same applies to the following description) is between the falling end position 324 of the minor peak 341 and the second position 302. A maximum load A1 during the minor peak is greater than or equal to a load A2 in the ON switching position 311 (more specifically, a greater one of the load in the first ON switching position and the load in the second ON switching position) and less than a load A3 in the OFF switching position 312 (more specifically, a smaller one of the load in the first OFF switching position and the load in the second OFF switching position).

Accordingly, when the movable member 12 starts to be pressed, the movable member 12 is pressed abruptly after a slightly resistive tactile click feel and transitions to the second position 302. That is, during normal operation, the movable member 12 cannot be stopped partway after the minor peak 341 and speedily transitions to the second position 302 with a feel that the movable member 12 strikes something. As a result, the operator is able to clearly feel that the movable member 12 has reached the second position 302. In other words, the operator is able to clearly feel an increase in load relative to the amount of press at a stage before the switch is further pressed from the ON state in the second position 302 and transitions to the OFF state in the third position 303.

From the above-described viewpoint, the ON switching position 311 is not limited to the position illustrated in FIG. 22. The ON switching position 311 may be any position between the falling start position 323 of the minor peak 341 and the second position 302. From the viewpoint of causing the movable member 12 to speedily transition from the minor peak 341 to the second position 302, the maximum load A1 during the minor peak 341 is preferably greater than a load A4 in the second position 302. Moreover, in order to prevent the switch that has passed the minor peak 341 from transitioning to the OFF state beyond the second position, the maximum load during the minor peak 341 is preferably less than the load in a position immediately before the OFF switching position 312 (more specifically, the loads in positions immediately before the first OFF switching position and the second OFF switching position; in general, the load in the position 332).

The rising start position 321 of the minor peak 341 may be almost or exactly the same as the first position 301. Even in this case, the operator is able to receive a resistive feel when the movable member 12 is pressed. In particular, when the minor peak 341 rises almost vertically, i.e., when the positions 321 and 322 are almost the same, the operator is able to more clearly receive a resistive feel. Of course, even if the rising start position 321 of the minor peak 341 is apart from the first position 301, it is preferable that the minor peak 341 rises almost vertically.

Moreover, in order for the operator to clearly feel the transition to the second position 302 after having received a resistive feel with a press of the movable member 12, it is preferable that the minor peak 341 and the second position 302 are apart enough from each other. Specifically, the position of the maximum load during the minor peak 341 is preferably closer to the first position 301 than to a midpoint position between the first position 301 and the second position 302. This is because, if the minor peak 341 is close to the second position 302, the minor peak 341 may be misdetected as the major peak 342.

In the enabling switch 1 having the characteristics illustrated in FIG. 22, even with the provision of the minor peak 341, there is no need to change a design load necessary to hold the movable member 12 in the second position 302. Thus, even if the operation part including the enabling switch 1 has been grasped in the second position 302 for a long time, strain will not be imposed on the operator. Moreover, the provision of the minor peak 341 brings about the effect of preventing the enabling switch 1 from unintentionally transitioning to an ON state in cases such as where the movable member 12 is touched by mistake or where the movable member 12 comes in contact with other objects.

Although the change in load from the falling of the minor peak 341 to the second position 302 is indicated by the straight line in FIG. 22, the change is not limited to a change indicated by the straight line as long as there are no large changes. For example, the rate of change in load may be changed in the ON switching position 311 and the load curve may be bent, or the load may slightly change stepwise in the ON switching position 311.

Next is a description of how the enabling switch 1 illustrated in FIGS. 20 and 21 achieves the characteristics illustrated in FIG. 22.

Figure 23:
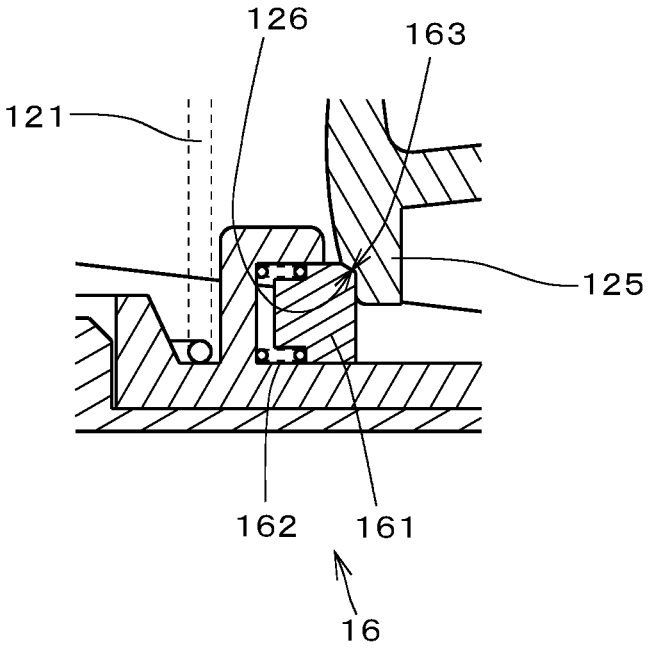
FIG. 23 is a longitudinal sectional view illustrating an area in close proximity to a resistance mechanism.

FIG. 23 is an enlarged view of the resistance mechanism 16 when the movable member 12 is located in the first position 301. A tip portion of the engaging part 161 has an inclined face 163. The lower portion 125 of the inner wall of the movable member 12 has an inclined face 126. In the state illustrated in FIG. 23, the engaging part 161 and the lower portion 125 are engaged with each other such that the inclined face 163 and the inclined face 126 are in parallel contact with each other. Hereinafter, the lower portion 125 of the inner wall of the movable member 12 is referred to as an "engaging part." The inclined face 163 is inclined downward in the right direction in FIG. 23. The inclined face 126 is inclined upward in the left direction.

Figure 24:
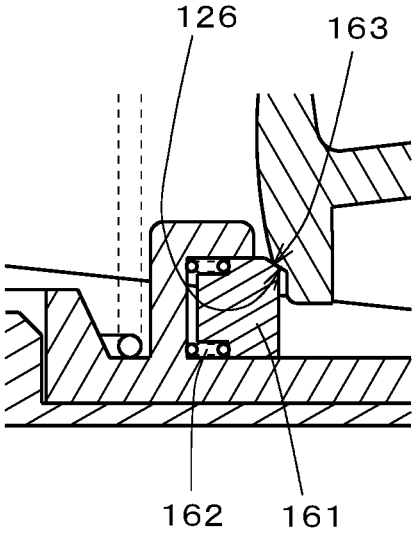
FIG. 24 is a longitudinal sectional view illustrating the area in close proximity to the resistance mechanism.

When the movable member 12 starts to be pressed from the first position 301, the movable member 12 is rotated counterclockwise with the coil spring 121 compressed, and the inclined face 126 presses the inclined face 163 while moving in the lower right direction. Accordingly, the engaging part 161 moves to the left against the force exerted from the coil spring 162 as illustrated in FIG. 24. The above-described operation causes the load necessary to press the movable member 12 to rise sharply. That is, in the enabling switch 1, the rising start position 321 of the minor peak 341 in FIG. 22 is the same as the first position 301. Of course, the inclined face 163 and the inclined face 126 may be spaced from each other in the state in which the movable member 12 is located in the first position 301. In this case, the first position 301 is not the same as the rising start position 321.

Figure 25:
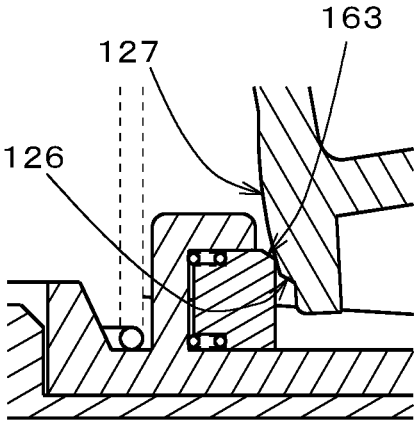
FIG. 25 is a longitudinal sectional view illustrating the area in close proximity to the resistance mechanism.

While the inclined face 163 and the inclined face 126 are in sliding contact with each other, the load increases and the movable member 12 reaches the position 322 and moves toward the position 323. When the edge of the inclined face 163 has matched with the edge of the inclined face 126, the engagement of the engaging part 161 and the engaging part 125 is released, and the load decreases considerably. That is, the movable member 12 moves from the position 323 to the position 324. In the case of the enabling switch 1 in FIG. 20, the position 323 and the position 324 are in close proximity to each other. When the switch has reached the position 324, the edge of the inclined face 163 moves smoothly over a curved face 127 located above the inclined face 126 as illustrated in FIG. 25.

Figure 26:
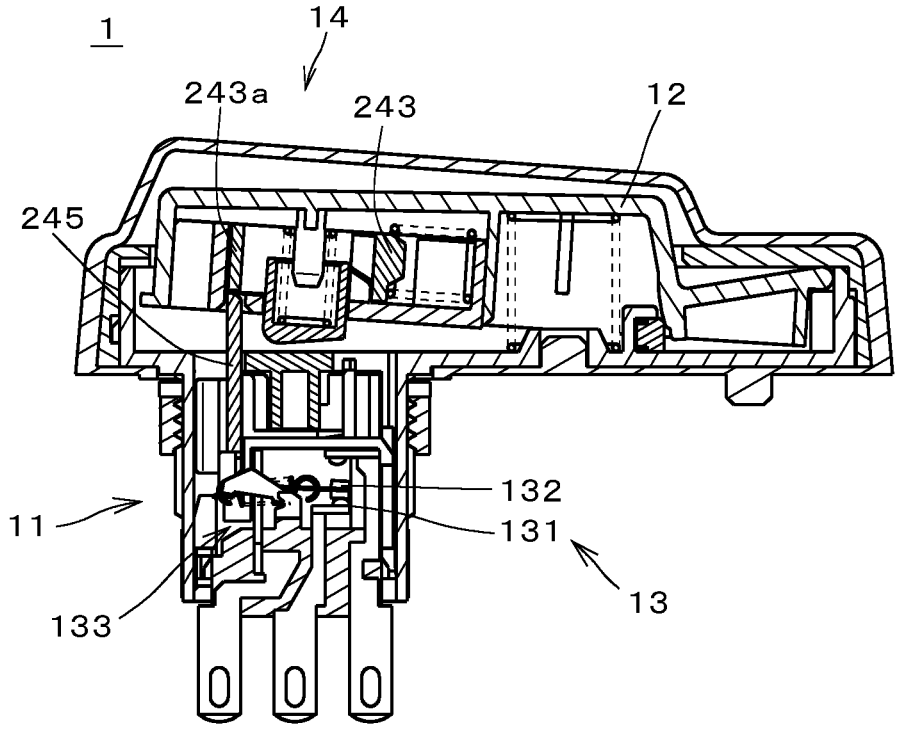
FIG. 26 is a longitudinal sectional view of the enabling switch when a movable member is located in an ON switching position.

In the enabling switch 1, almost simultaneously with or immediately after the decrease in load, the rear end portion 243*a* of the slider 243 and the upper end of the press member 245 come in contact with each other as illustrated in FIG. 26. The press member 245 also moves downward with the downward movement of the movable member 12 and presses a specific portion of the snap mechanism 133. When the press member 245 has moved down to a predetermined position as illustrated in FIG. 26, the movable terminal 132 is instantaneously moved downward by snap action of the snap mechanism 133, and the contacts 13 transition to a closed state.

Figure 27:
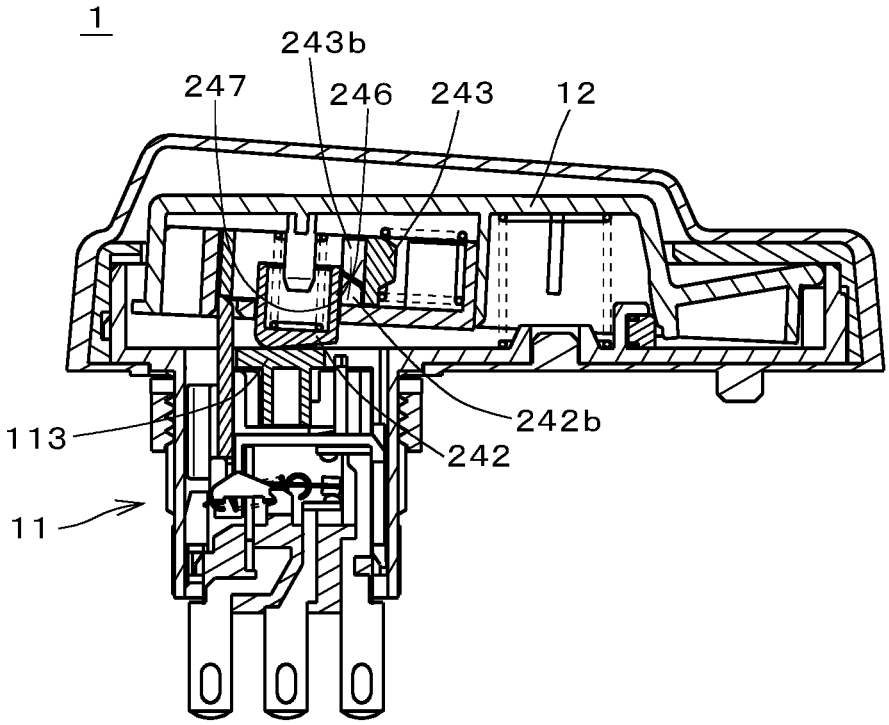
FIG. 27 is a longitudinal sectional view of the enabling switch when the movable member is located in a second position.

When the movable member 12 has further moved downward, the lower end of the abutment member 242 comes in contact with the upper face of a lower abutment member 113, which is one part of the holder 11, as illustrated in FIG. 27. The position of the movable member 12 illustrated in FIG. 27 is the second position 302.

When a downward force is applied to the movable member 12 in the state illustrated in FIG. 27, an upward force relative to the movable member 12 is exerted on the abutment member 242. The upper face of the right-side portion 242*b* of the abutment member 242 has an inclined face 246 that is inclined downward in the right direction. On the other hand, the left-side portion 243*b* of the right-side tip portion of the slider 243, i.e., the lower face of the portion on the side of the abutment member 242, has an inclined face 247 that is inclined upward in the left direction. The inclined face 246 and the inclined face 247 are almost in parallel contact with each other.

Figure 28:
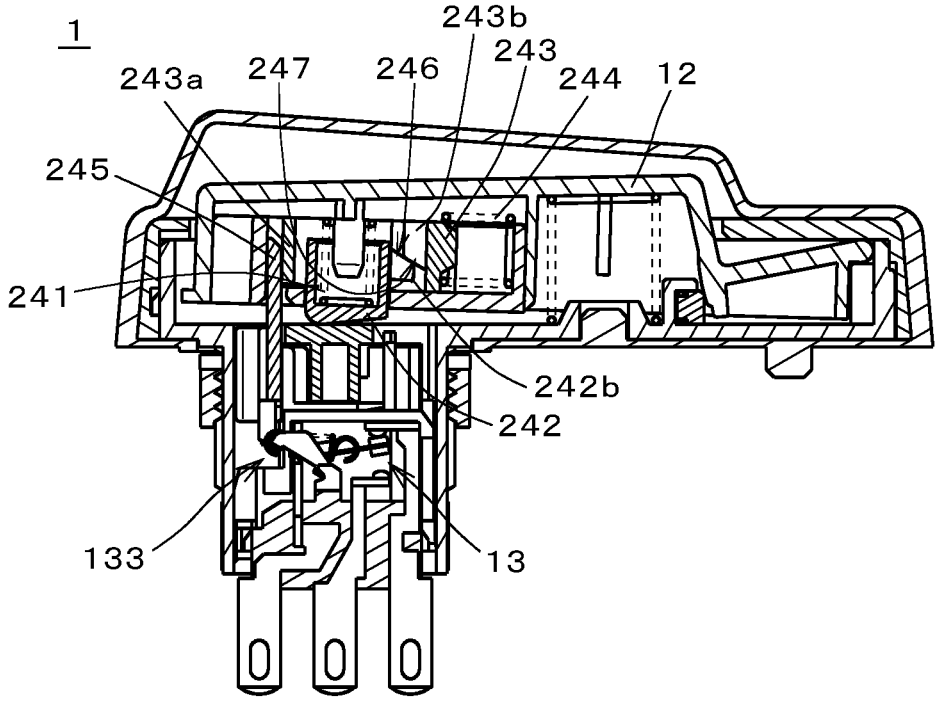
FIG. 28 is a longitudinal sectional view of the enabling switch when the movable member is located in an OFF switching position.

Thus, when the load applied to the movable member 12 is increased so that an upward force is exerted from the abutment member 242 on the slider 243, the slider 243 starts to move in the right direction against the force exerted from the horizontal coil spring 244 as illustrated in FIG. 28. At this time, the vertical coil spring 241 shrinks. This state is the state of transition from the position 302 to the position 333 via the position 332.

When the slider 243 has moved in the right direction, the abutment of the rear end portion 243*a* of the slider 243 and the press member 245 in the up-down direction is released. As a result, the press member 245 moves upward under the force received from the snap mechanism 133, and the contacts 13 transition from the closed state to the open state.

When the edge of the inclined face 246 has matched with the edge of the inclined face 247, the movable member 12 moves downward such that the right-side portion 242*b* of the abutment member 242 and the left-side portion 243*b* of the tip portion of the slider 243 are in sliding contact with each other. At this time, the load decreases abruptly. Accordingly, the movable member speedily reaches the position 334 from the position 333. In the case of the enabling switch 1 in FIGS. 20 and 21, the positions 333 and 343 are almost the same. Through the operation described above, the major peak 342 is obtained.

Figure 29:
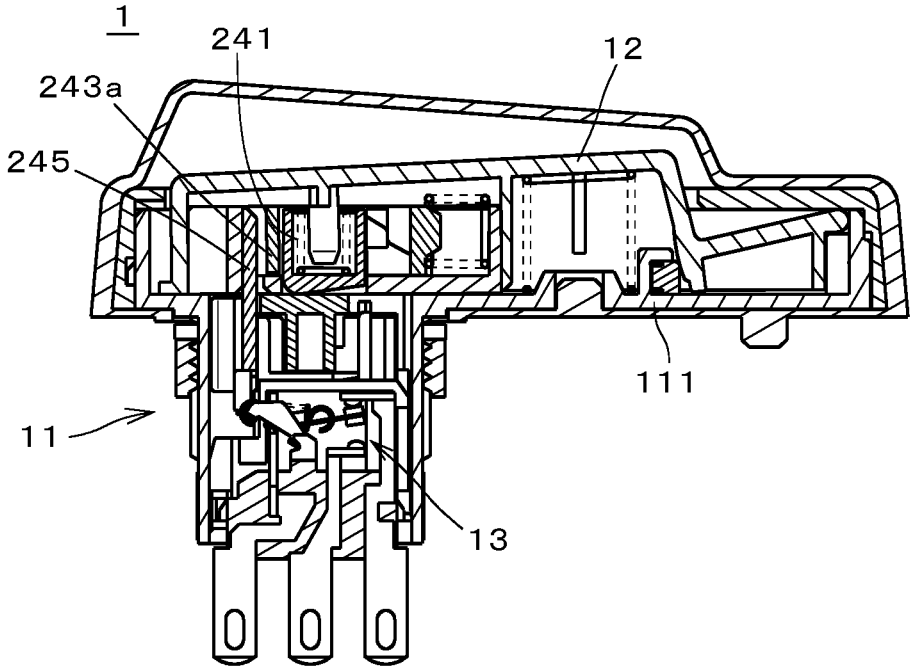
FIG. 29 is a longitudinal sectional view of the enabling switch when the movable member is located in a third position.

When the movable member 12 is most pressed as illustrated in FIG. 29, the vertical coil spring 241 is further compressed, and the lower end of the movable member 12 comes in contact with the upper face of the base member 111 of the holder 11. This state corresponds to the third position 303, and downward movement of the movable member 12 is disabled.

When the operator has moved his or her finger off the enabling switch 1 in the state illustrated in FIG. 29, the movable member 12 moves upward while maintaining a state in which the rear end portion 243*a* of the slider 243 and the press member 245 deviate from each other in the lateral direction. When the slider 243 is located above the upper end of the press member 245, the rear end portion 243*a* of the slider 243 is located immediately above the press member 245 under the force received from the horizontal coil spring 244 as illustrated in FIG. 20. Accordingly, the contacts 13 are maintained in the open state until the movable member 12 returns to the first position 301 in FIG. 20. That is, the enabling switch 1 is maintained in the OFF state when the movable member 12 is returning from the third position 303. When the operator has moved his or her finger off the movable member 12 from the second position 302, the movable member 12 returns to the first position 301, and the enabling switch 1 returns to the OFF state.

As described above, in the enabling switch 1, the presence of the minor peak 341 prevents operation from being stopped partway in any position between the minor peak 341 and the second position 302 during normal operation, and enables the operator to clearly feel that the movable member 12 has reached the second position 302. In the case where the two contacts 13 are provided in order to improve reliability as in the enabling switch 1, even if the movable member 12 is inclined, it is possible, by making a speedy transition from the minor peak 341 to the second position 302, to considerably shorten the duration of time that the two contacts 13 remain in different states. That is, the difference in switching timing between the two contacts 13 can be reduced. As a result, it is possible to prevent misdetection of an error caused by the fact that the two contacts 13 remain in different states for a given period of time or more.

Figure 30:
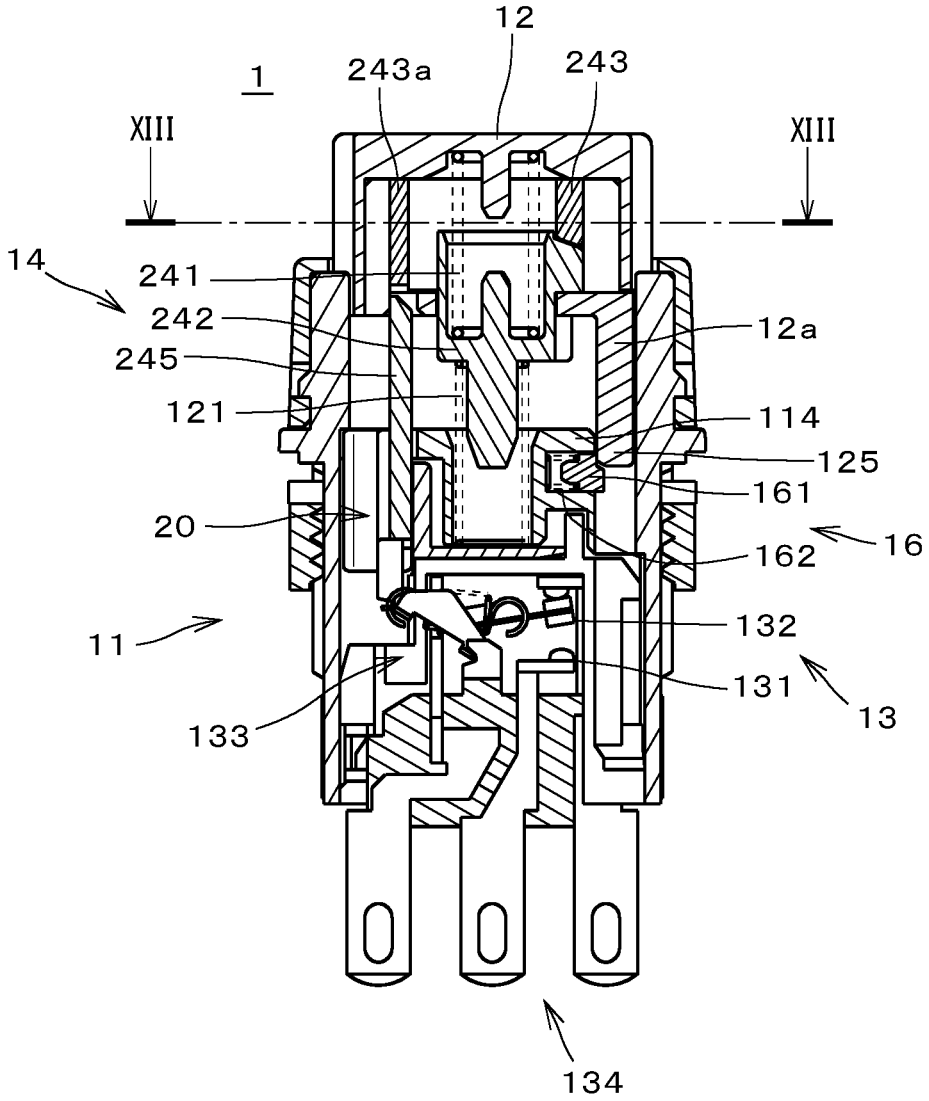
FIG. 30 is a longitudinal sectional view of another enabling switch.
Figure 31:
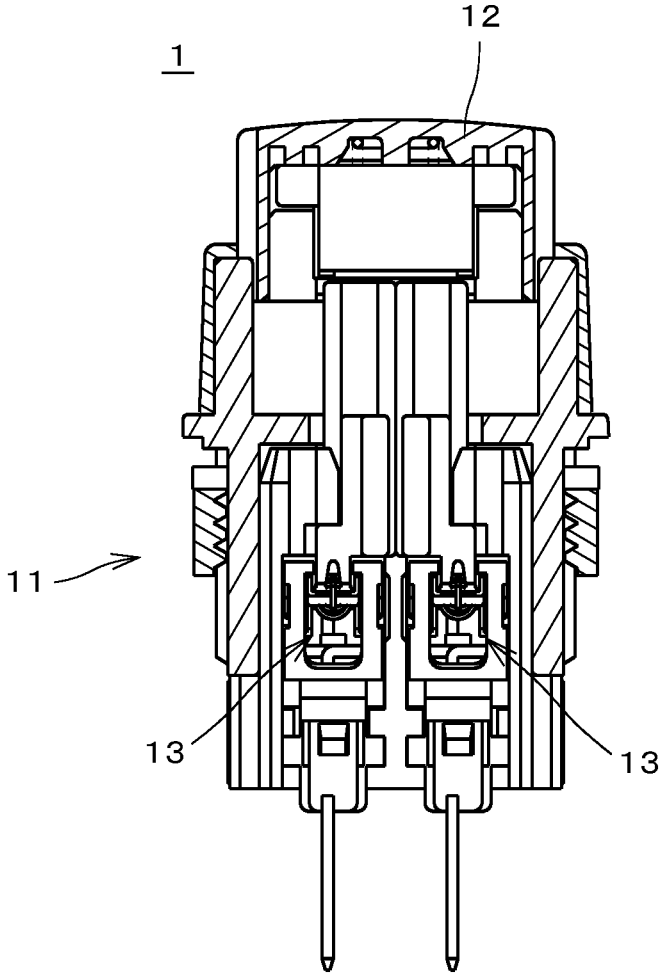
FIG. 31 is a longitudinal sectional view of the enabling switch.
Figure 32:
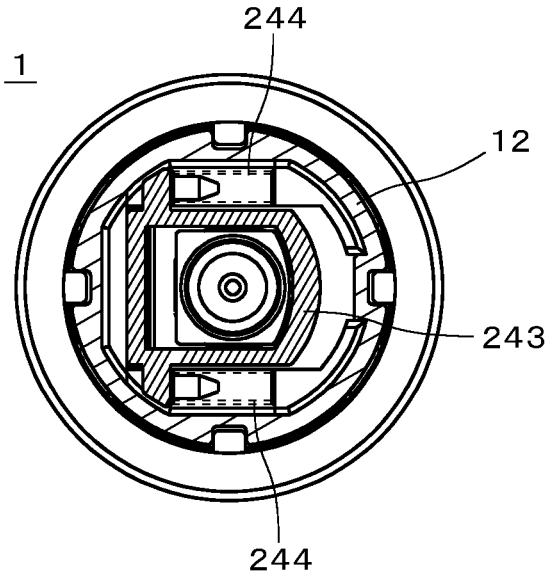
FIG. 32 is a cross-sectional view of the enabling switch.

FIGS. 30 and 31 are longitudinal sectional views of an enabling switch 1 according to yet another example. FIG. 30 is a longitudinal sectional view of the enabling switch 1 as viewed from the front, and FIG. 31 is a longitudinal sectional view as viewed from one side. FIG. 32 is a cross-sectional view of the enabling switch 1 taken in a position XIII-XIII in FIG. 30.

The enabling switch 1 includes a holder 11 and a movable member 12. In the operation of the enabling switch 1, the movable member 12 is pressed downward in FIGS. 30 and 31 into the holder 11 by an operator. The up-down direction in FIGS. 30 and 31 does not necessarily have to match with the direction of gravity. The holder 11 supports members of the enabling switch 1 other than the holder 11. A coil spring 121 in the holder 11 illustrated in FIG. 30 indirectly applies a force that is exerted upward in FIG. 30 on the movable member 12. In FIG. 30, the coil spring 121 and other coil springs are indicated by broken lines in simplified form.

When the operator has pressed the movable member 12 into the holder 11 with his or her finger and then moved the finger off the movable member 12, the movable member 12 is returned to its original position by the force of the coil spring 121 (or the coil spring 121 and a vertical coil spring 241 described later).

The enabling switch 1 includes, in the holder 11, two contacts 13 (see FIG. 31) and a contact mechanism 20 that causes the contacts 13 to transition from an open or closed state. Each contact 13 is a combination of a lower fixed terminal 131 and a movable terminal 132. More specifically, there is also an upper fixed terminal, and connection terminal groups 134 that each include three connection terminals connected respectively to the upper fixed terminal, the lower fixed terminal 131, and the movable terminal 132 are located below the holder 11. In the open state of each contact 13, the lower fixed terminal 131 and the movable terminal 132 are spaced from each other. In the closed state of each contact 13, the lower fixed terminal 131 and the movable terminal 132 are in contact with each other. In the open state of the contacts 13, the enabling switch 1 is in an OFF state, and in the closed state of the contacts 13, the enabling switch 1 is in an ON state.

Inside and below the movable member 12, an OFF switching mechanism 14 is arranged. The OFF switching mechanism 14 includes the vertical coil spring 241, an abutment member 242 that houses the vertical coil spring 241, a slider 243, two horizontal coil springs 244 (see FIG. 32), and a press member 245. A lower member 12*a* of the movable member 12 has a hole, and the abutment member 242 is fitted in the hole of the lower member 12*a*. As illustrated in FIG. 32, the two horizontal coil springs 244 are located on the opposite sides of the slider 243 and apply a force that is exerted in the left direction in FIG. 30 on the slider 243. The slider 243 and the horizontal coil springs 244 are arranged in the space between the upper portion of the movable member 12 and the lower member 12*a*.

In the initial state illustrated in FIG. 30, the slider 243 receives a leftward force from the horizontal coil springs 244, the abutment member 242 receives a downward force from the vertical coil spring 241, and a right-side tip portion of the slider 243 is located above a right-side portion of the abutment member 242. The lower end of a rear end portion 243*a* of the slider 243 is in close proximity to the upper end of the press member 245.

The movable terminal 132 is connected to a snap mechanism 133. As will be described later, when the press member 245 has been pressed to a predetermined position, the movable terminals 132 are speedily moved toward the lower fixed terminals 131 by a spring of the snap mechanism 133, and the movable terminals 132 and the lower fixed terminals 131 are brought into contact with each other. That is, the contacts 13 become closed.

As will be described later, the OFF switching mechanism 14 and the snap mechanism 133 configure the contact mechanism 20 that causes the contacts 13 to transition from an open state to a closed state and further from the closed state to the open state as the movable member 12 is pressed toward the holder 11. The enabling switch 1 includes the two contacts 13, and when these contacts are distinguished respectively as a "first contact 13" and a "second contact 13," the contact mechanism 20 causes the first contact 13 and the second contact 13 to transition from an open state to a closed state and further from the closed state to the open state as the movable member 12 is pressed toward the holder 11.

The contact mechanism 20 further includes a resistance mechanism 16 provided in close proximity to the lower portion of the lower member 12*a*. The resistance mechanism 16 is provide in a hole of a central member 114 that is open in the right direction, the central member being part of the holder 11. The resistance mechanism 16 includes an engaging part 161 and a coil spring 162. More specifically, a portion of the central member 114 that is located in close proximity to the engaging part 161 and the coil spring 162 also forms part of the resistance mechanism 16. The coil spring 162 presses the engaging part 161 in the right direction in FIG. 30, i.e., toward a lower portion 125 of the lower member 12*a*. In the initial state illustrated in FIG. 30, the engaging part 161 is in contact with the lower portion 125. As will be described later, the resistance mechanism 16 exerts a force resistant to the movement of the movable member 12 on the movable member 12 at an initial stage of press of the movable member 12.

Next is a description of how the enabling switch 1 illustrated in FIGS. 30 to 32 achieve the characteristics illustrated in FIG. 22.

Figure 33:
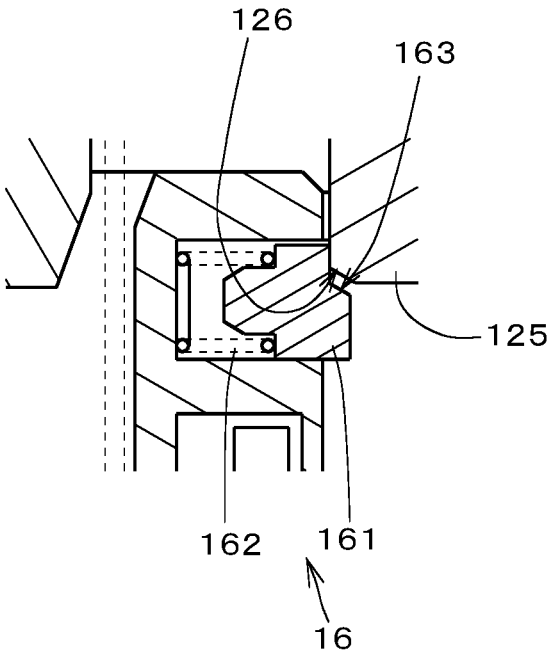
FIG. 33 is a longitudinal sectional view illustrating an area in close proximity to a resistance mechanism.

FIG. 33 is an enlarged view of the resistance mechanism 16 when the movable member 12 is located in the first position 301. A tip portion of the engaging part 161 has an inclined face 163. The lower portion 125 of the lower member 12*a* has an inclined face 126. In the state illustrated in FIG. 33, the inclined face 163 and the inclined face 126 are slightly spaced from each other and in parallel with each other. Hereinafter, the lower portion 125 of the lower member 12*a* is referred to as an "engaging part." The inclined face 163 is inclined downward in the right direction in FIG. 33. The inclined face 126 is inclined upward in the left direction.

Figure 34:
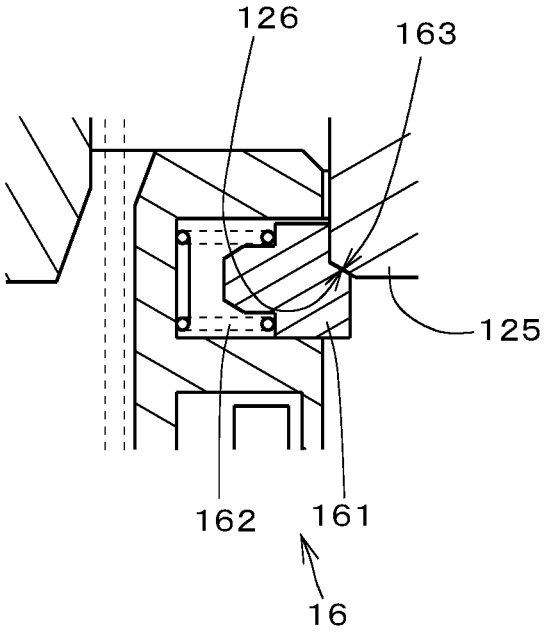
FIG. 34 is a longitudinal sectional view illustrating the area in close proximity to the resistance mechanism.

When the movable member 12 starts to be pressed from the first position 301, the coil spring 121 is compressed, and as illustrated in FIG. 34, the inclined face 163 and the inclined face 126 are brought into abutment with each other. This increases the load to press the movable member 12. The position of the movable member 12 in FIG. 34 is a rising start position 321 of a minor peak 341. As illustrated in FIG. 33, the inclined face 126 and the inclined face 163 are just slightly spaced from each other in the first position 301. Thus, the first position 301 is close to the position 321.

Figure 35:
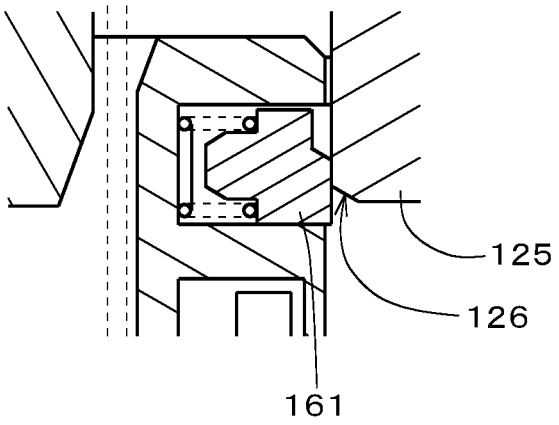
FIG. 35 is a longitudinal sectional view illustrating the area in close proximity to the resistance mechanism.

When the load applied to the movable member 12 is increased, the engaging part 161 starts to move in the left direction against the force exerted from the coil spring 162. This state is the state of transition from the position 321 to the position 322. When the edge of the inclined face 163 has matched with the edge of the inclined face 126, the engagement of the engaging part 161 and the engaging part 125 is released, and the load decreases considerably. That is, the movable member 12 speedily moves from the position 323 to the position 324. In the case of the enabling switch 1 illustrated in FIG. 30, the positions 323 and 324 are almost the same. Then, as illustrated in FIG. 35, the movable member moves downward such that the side face of the engaging part 125 is rubbing against the tip of the engaging part 161.

Figure 36:
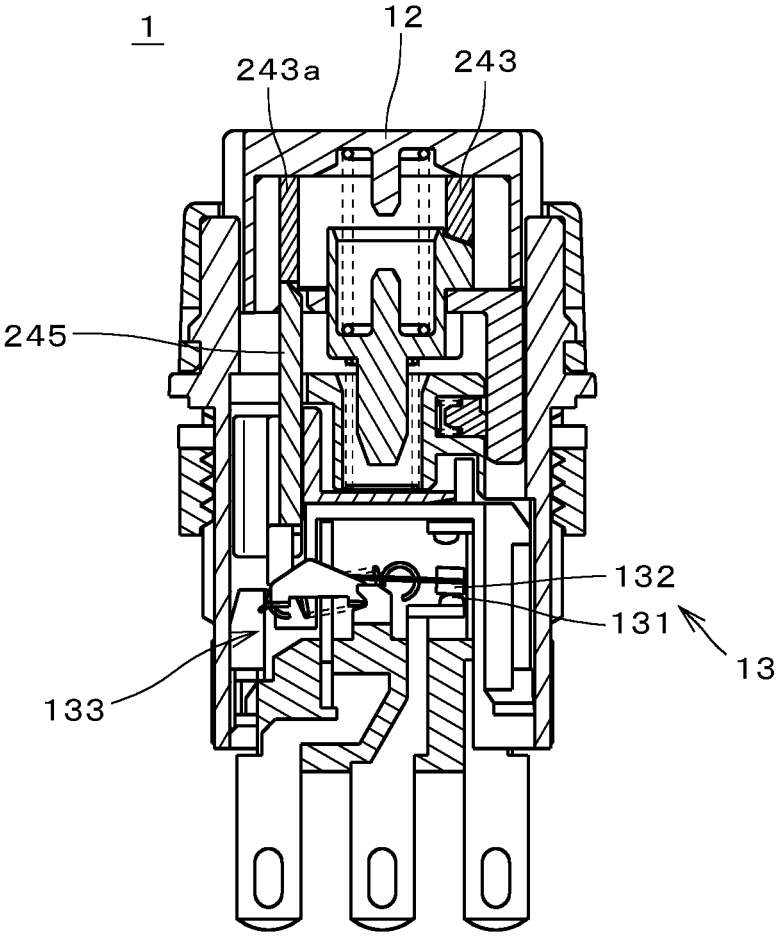
FIG. 36 is a longitudinal sectional view of the enabling switch when a movable member is located in an ON switching position.

In the enabling switch 1, almost simultaneously with or immediately after the decrease in load, the rear end portion 243*a* of the slider 243 and the upper end of the press member 245 come in contact with each other (see FIG. 36). The press member 245 also moves downward with the downward movement of the movable member 12 and presses a specific portion of the snap mechanism 133. As illustrated in FIG. 36, when the press member 245 has moved down to a predetermined position, the movable terminal 132 is instantaneously moved down by snap action of the snap mechanism 133, and the contacts 13 transition to the closed state.

Figure 37:
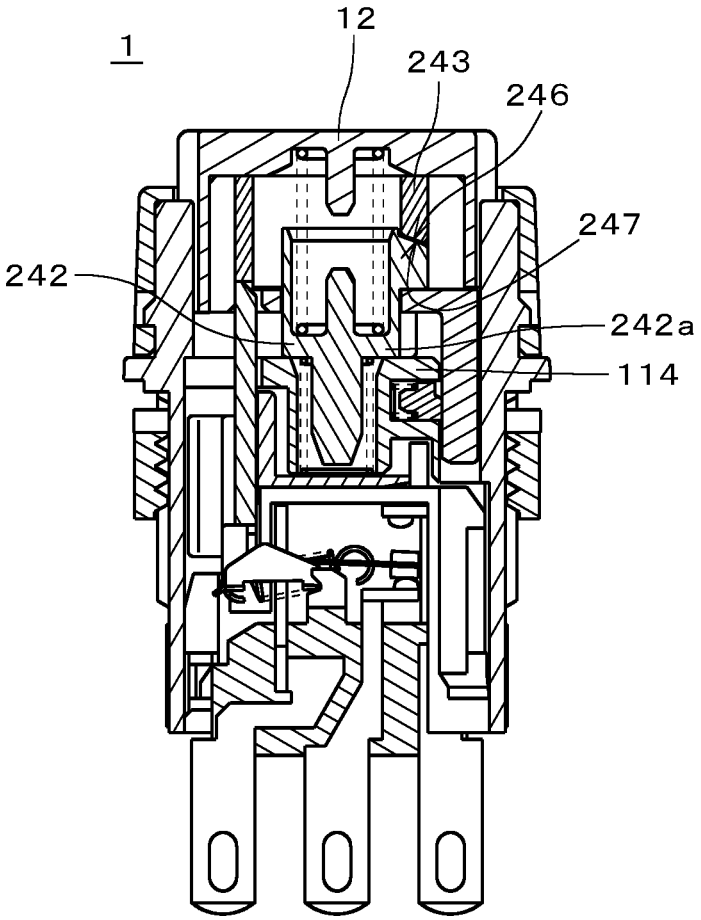
FIG. 37 is a longitudinal sectional view of the enabling switch when the movable member is located in a second position.

When the movable member 12 has further moved down, the lower face of a stepped portion 242*a* of the abutment member 242 comes in contact with the upper face of the central member 114 as illustrated in FIG. 37. The position of the movable member 12 illustrated in FIG. 37 is the second position 302.

When a downward force is applied to the movable member 12 in the state illustrated in FIG. 37, a relatively upward force is exerted on the abutment member 242. The upper face of the right-side portion of the abutment member 242 has an inclined face 246 that is inclined downward in the right direction. On the other hand, the lower face of the right-side tip portion of the slider 243 has an inclined face 247 that is inclined upward in the left direction. The inclined face 246 and the inclined face 247 are almost in parallel contact with each other.

Figure 38:
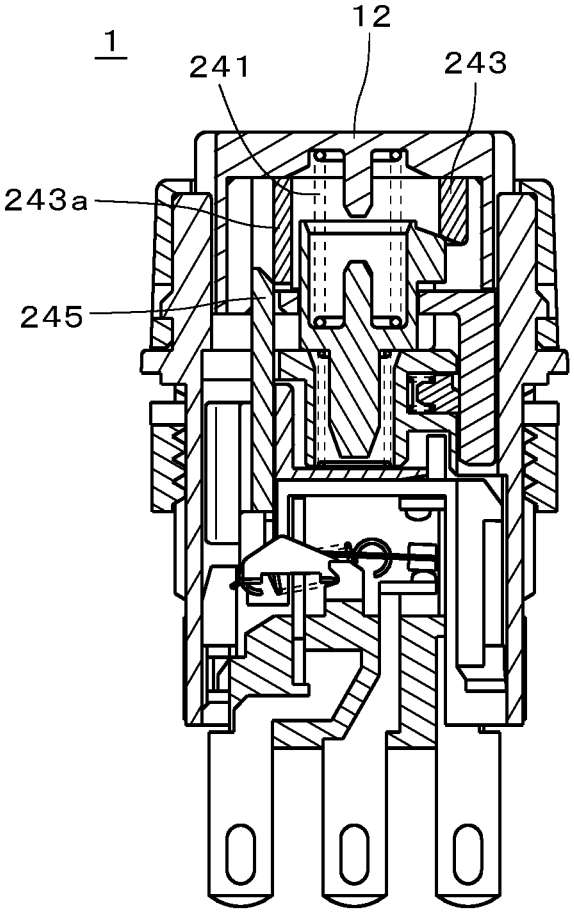
FIG. 38 is a longitudinal sectional view of the enabling switch when the movable member is located in a position immediately before an OFF switching position.

Accordingly, when the load applied to the movable member 12 is increased so as to exert an upward force from the abutment member 242 on the slider 243, the slider 243 starts to move in the right direction against the force exerted from the horizontal coil spring 244 (see FIG. 32) as illustrated in FIG. 38. At this time, the vertical coil spring 241 shrinks. This state is the state of transition from the position 302 to the position 333 via the position 332.

Figure 39:
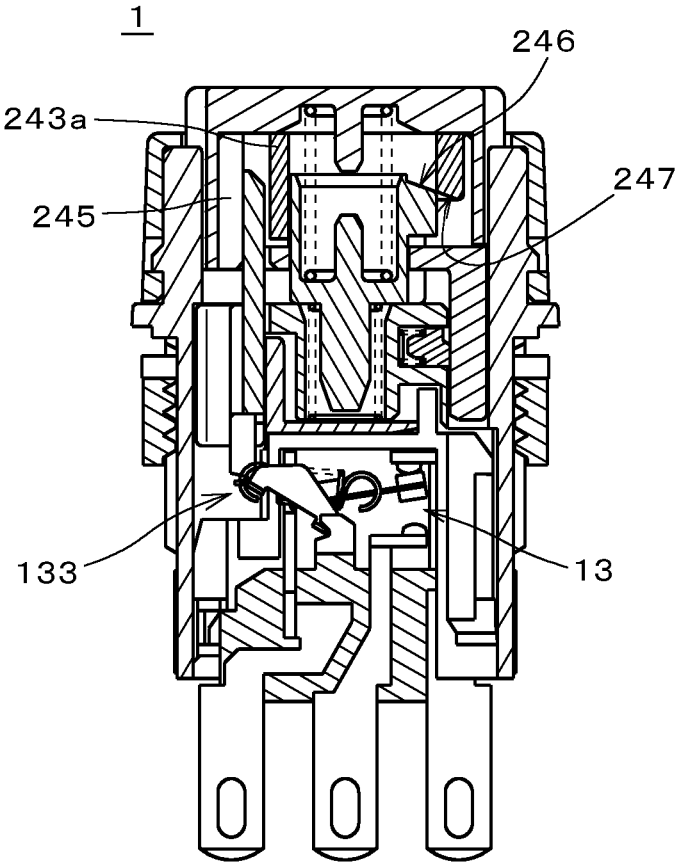
FIG. 39 is a longitudinal sectional view of the enabling switch when the movable member is located in the OFF switching position.

When the slider 243 has moved in the right direction, the abutment of the rear end portion 243*a* of the slider 243 and the press member 245 in the up-down direction is released. As a result, as illustrated in FIG. 39, the press member 245 moves upward under the force received from the snap mechanism 133, and the contacts 13 transition from the closed state to the open state.

Figure 40:
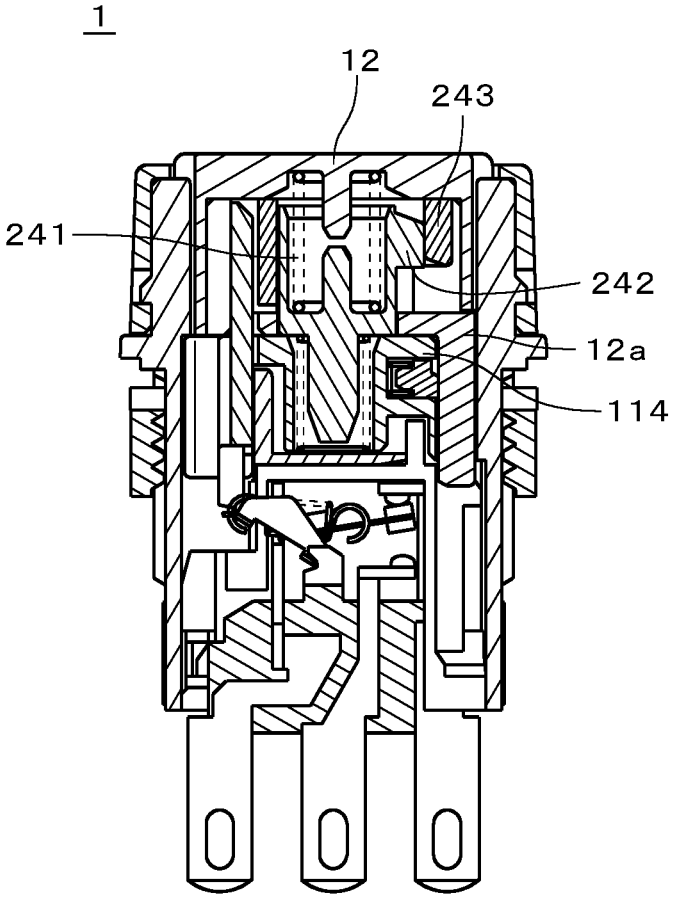
FIG. 40 is a longitudinal sectional view of the enabling switch when the movable member is located in a third position.

When the edge of the inclined face 246 has matched with the edge of the inclined face 247, the movable member 12 moves downward such that the right side face of the upper portion of the abutment member 242 is rubbing against the left side face of the right-side tip portion of the slider 243 as illustrated in FIG. 40. At this time, the load decreases abruptly. Accordingly, the movable member speedily reaches the position 334 from the position 333. In the case of the enabling switch 1 illustrated in FIGS. 30 to 32, the positions 333 and 334 are almost the same. Through the operation described above, the major peak 342 is obtained.

When the movable member 12 is most pressed as illustrated in FIG. 40, the vertical coil spring 241 is further compressed, and the lower member 12*a* of the movable member 12 comes in contact with the upper face of the central member 114. This state corresponds to the third position 303, and downward movement of the movable member 12 is disabled.

Figure 41:
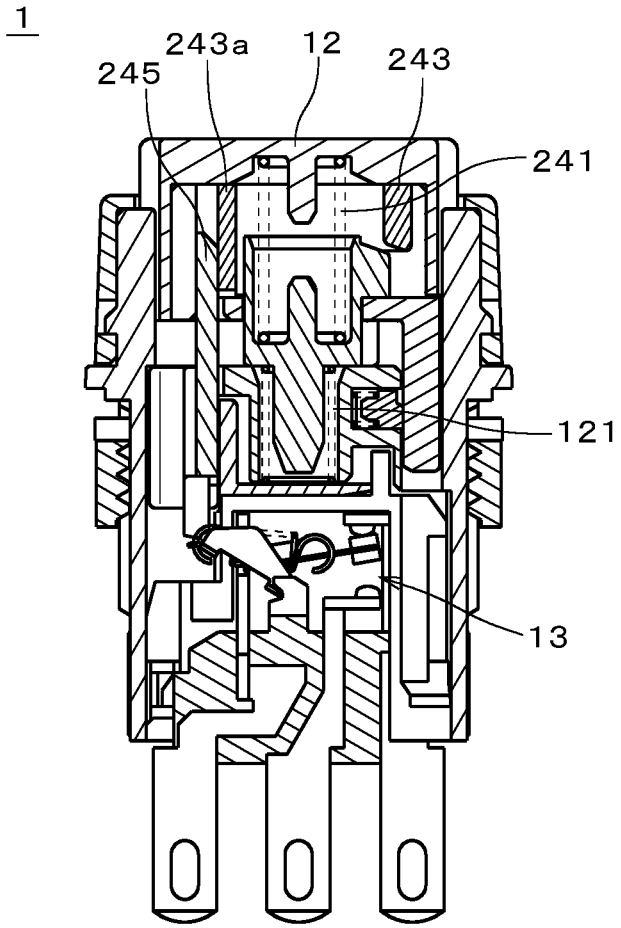
FIG. 41 is a longitudinal sectional view of the enabling switch when the movable member is returning to an original position.

When the operator has moved his or her finger off the enabling switch 1 in the state illustrated in FIG. 40, as illustrated in FIG. 41, the vertical coil spring 241 is extended before the coil spring 121, and the movable member 12 moves upward while maintaining a state in which the rear end portion 243*a* of the slider 243 and the press member 245 deviate from each other in the lateral direction. When the slider 243 is located above the upper end of the press member 245, the rear end portion 243*a* of the slider 243 is located immediately above the press member 245 under the force received from the horizontal coil spring 244 as illustrated in FIG. 30. Thereafter, the coil spring 121 is extended. Accordingly, the contacts 13 are maintained in the open state until the movable member 12 returns to the first position 301 in FIG. 30. That is, the enabling switch 1 is maintained in the OFF state when the movable member 12 is returning from the third position 303. When the operator has moved his or her finger off the movable member 12 in the second position 302, the movable member 12 returns to the first position 301, and the enabling switch 1 returns to the OFF state.

As described above, in the enabling switch 1 illustrated in FIGS. 30 to 32, the presence of the minor peak 341 prevents operation from being stopped partway in any position between the minor peak 341 and second position 302 during normal operation and enables the operator to clearly feel that the movable member 12 has reached the second position 302. Moreover, even if the movable member 12 is inclined, it is possible, by making a speedy transition from the minor peak 341 to the second position 302, to considerably shorten the duration of time that the two contacts 13 remain in different states. That is, the difference in switching timing between the two contacts 13 can be reduced. As a result, it is possible to prevent misdetection of an error caused by the fact that the two contacts 13 remain in different states for a given period of time or more.

Figure 42:
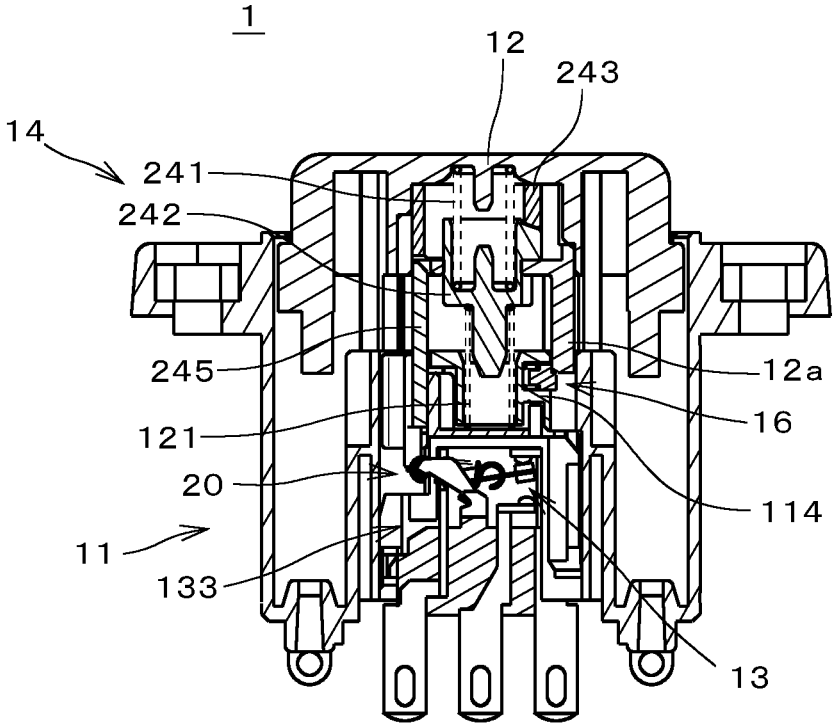
FIG. 42 is a longitudinal sectional view of another enabling switch.
Figure 43:
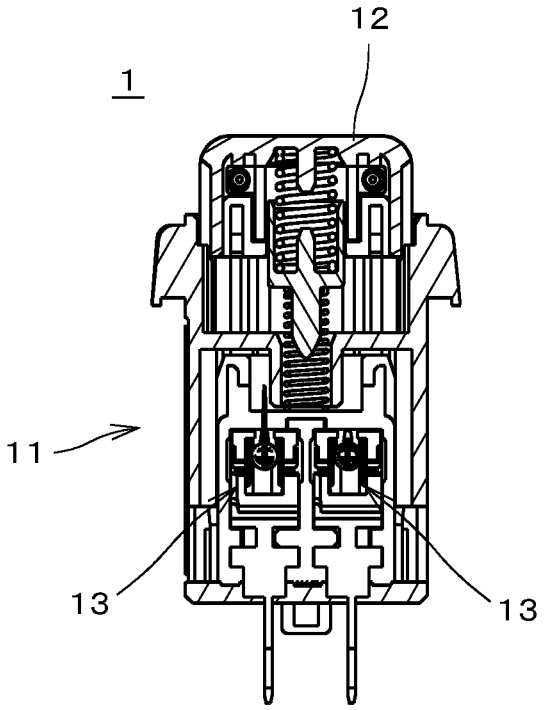
FIG. 43 is a longitudinal sectional view of the enabling switch.

FIGS. 42 and 43 are longitudinal sectional views of an enabling switch 1 according to yet another example. FIG. 42 is a longitudinal sectional view of the enabling switch 1 as viewed from the front, and FIG. 43 is a longitudinal sectional view thereof as viewed from one side. In FIGS. 42 and 43, the movable member 12 is located in the first position 301.

The enabling switch 1 illustrated in FIGS. 42 and 43 has the same structure as the enabling switch 1 illustrated in FIGS. 30 to 32, except that the shapes of the holder 11 and the movable member 12 are modified. In FIGS. 42 and 43, the same reference signs are assigned to constituent elements that are the same as those in FIGS. 30 and 31.

Figure 44:
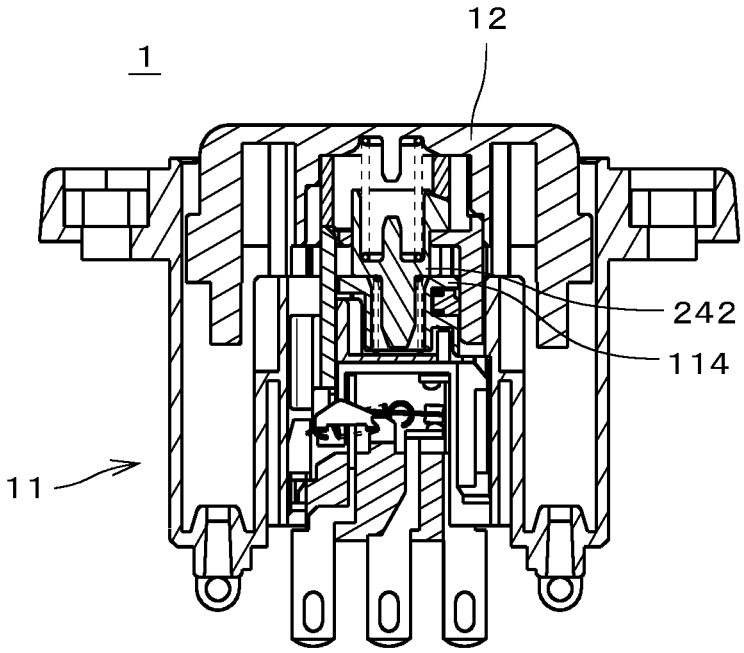
FIG. 44 is a longitudinal sectional view of the enabling switch when a movable member is located in a second position.
Figure 45:
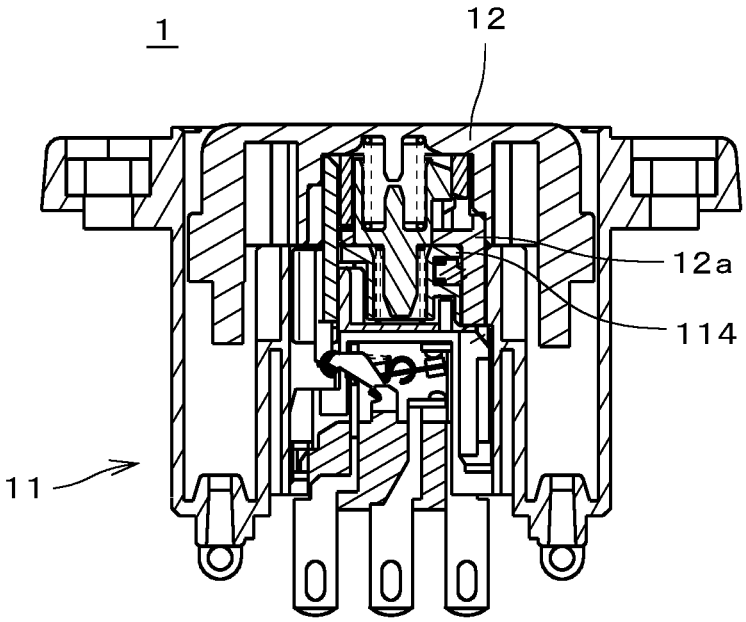
FIG. 45 is a longitudinal sectional view of the enabling switch when the movable member is located in a third position.

In FIG. 44, the movable member 12 is located in the second position 302, and the abutment member 242 and the central member 114 are in contact with each other. In FIG. 45, the movable member 12 is located in the third position 303, and the lower member 12*a* of the movable member 12 and the central member 114 are in contact with each other. The contact mechanism 20 of the enabling switch 1 illustrated in FIGS. 42 and 43 is the same as the contact mechanism 20 of the enabling switch 1 illustrated in FIGS. 30 to 32, and a detailed description thereof shall be omitted. In the enabling switch 1 illustrated in FIGS. 42 and 43 as well as in the enabling switch 1 illustrated in FIGS. 30 to 32, the operator is able to clearly feel that the movable member 12 has reached the second position 302, and it is possible to prevent misdetection of an error caused by the fact that the two contacts 13 remain in different states for a given period of time or more.

The resistance mechanism 16 of the enabling switch 1 may be modified in various ways. In the above-described embodiment, the resistance mechanism 16 includes the engaging part 161 and the coil spring 162 arranged between the holder 11 and the engaging part 161, and the minor peak 341 is obtained by engaging the engaging part 161, which receives a force from the coil spring 162, with the movable member 12 and then pressing the movable member 12 to release the engagement. In contrast, the resistance mechanism 16 may include an engaging part and a coil spring that is arranged between the movable member 12 and the engaging part. In this case, the minor peak 341 is obtained by engaging the engaging part, which receives a force from the coil spring, with the holder 11 and then pressing the movable member 12 to release the engagement. It is of course possible to provide the resistance mechanism 16 indirectly between the holder 11 and the movable member 12.

As described above, the engagement structure of the resistance mechanism 16 may be modified in various ways. When one engaging part (in the case of FIGS. 23 and 33, the engaging part 125) is regarded as a first engaging part and the other engaging part (in the case of FIGS. 23 and 33, the engaging part 161) that is engaged with the first engaging part is regarded as a second engaging part, the second engaging part moves relative to the first engaging part in accordance with the movement of the movable member 12. Then, the engagement of the first engaging part and the second engaging part is released when the movable member 12 is pressed toward the holder 11. This produces the minor peak 341 of the load. The first engaging part and the second engaging part may be spaced from each other in the first position 301 and once engaged and then disengaged with a press of the movable member 12, or they may already be engaged with each other in the first position 301. By using the engagement of the engaging parts, it is possible to obtain the minor peak 341 with a simple structure.

Note that the first engaging part does not necessarily have to receive a force from an elastic body such as a spring. The first engaging part and the second engaging part may be engaged with each other by gravity or a magnetic force when the movable member 12 is located in the position 321.

When the first engaging part receives a force from an elastic body, for example, a flat spring or a flexible portion of a resin may be used as the elastic body other than a coil spring. The elastic body may use various techniques to exert a force for the engagement between the first engaging part and the second engaging part. When expressed in general terms, the elastic body is directly or indirectly fixed to either one of the movable member 12 and the holder 11. The second engaging part is directly or indirectly mounted on the elastic body, and the first engaging part is directly or indirectly fixed to the other of the movable member 12 and the holder 11. Then, with a press of the movable member 12, the second engaging part moves against the force exerted from the elastic body to release the engagement. In this way, the minor peak 341 is obtained.

In the enabling switch 1, the minor peak 341 may be obtained without using any engaging part. For example, a rubber pad that is recessed abruptly by being pressed may be provided between the movable member 12 and the coil springs 121. The minor peak 341 may also be obtained by causing one of a pair of magnets that repel or attract each other to pass through an area located in close proximity to the other magnet.

The enabling switches 1 described above with reference to FIGS. 20 to 45 may be modified in various ways.

The number of contacts in the enabling switch 1 may be three or more.

The characteristics of the enabling switch 1 illustrated in FIG. 22 are applicable to various structures of enabling switches. For example, the characteristics may be applied to the enabling switches disclosed in Japanese Patent Application Laid-Open No. 2001-35300 and Japanese Patent Application Laid-Open No. 2002-42606, which are given by way of example as cited documents. As disclosed by way of example in these cited documents, various structures may be employed as the contact mechanism 20.

While the above-described enabling switch 1 uses snap action to open and close the contacts 13, the enabling switch 1 may close the contacts by causing the two terminals included in each contact 13 to gradually approach and come into contact with each other as the movable member 12 is pressed in close proximity to the ON switching position 311 toward the holder 11. In this case, it is possible, by making a speedy transition from the minor peak 341 to the second position 302, to suppress discharge occurring when the contacts 13 become closed and to suppress welding of the contacts 13.

The operation part including the enabling switch 1 is not limited to a teach pendant, and can be used as various operation parts such as operation parts of heavy equipment such as a hoist, operation parts of vehicles, and operation parts of motor-driven wheelchairs.

The configurations of the above-described preferred embodiments and variations may be appropriately combined as long as there are no mutual inconsistencies.

While the invention has been shown and described in detail, the foregoing description is in all aspects illustrative and not restrictive. It is therefore to be understood that numerous modifications and variations can be devised without departing from the scope of the invention.

INDUSTRIAL APPLICABILITY

The present invention is applicable as an enabling switch of an operation part for use in operation of various operation targets such as industrial robots, hoists, and wheelchairs.

REFERENCE SIGNS LIST

1 Enabling switch
11 Holder
12 Movable member
13 Contact (first contact and second contact)
20 Contact mechanism
125 Engaging part
131 Upper terminal
132 Lower terminal
161 Engaging part
162 Coil spring (elastic body)
261 Rotatable member
262 Fixed sliding contact part
263 Rotatable sliding contact part
264 Recess
301 First position
302 Second position
303 Third position
311 ON switching position (first ON switching position, second ON switching position)
312 OFF switching position (first OFF switching position, second OFF switching position)
323 Falling start position (of minor peak)
341 Minor peak
343 Maximum rise
J1 Rotation axis

The invention claimed is:

1. An enabling switch provided in an operation part and for enabling operation of an operation target by said operation part, the enabling switch comprising:

a holder;

a movable member that is pressed toward said holder;

a contact; and a contact mechanism that causes said contact to transition from an open state to a closed state and further from the closed state to the open state in accordance with a press of said movable member toward said holder, wherein a position of said movable member relative to said holder in a state in which said movable member is not pressed is given as a first position, a position of said movable member relative to said holder in a state in which said movable member is most pressed is given as a third position, and a rising start position of a maximum rise of a load required to press said movable member is given as a second position, the rising start position being between said first position and said third position, and the maximum rise being a rise in which the load rises and reaches its maximum with an increase in a rate of increase of the load relative to an amount of press, when said movable member is pressed, said contact transitions from the open state to the closed state in an ON switching position that is between said first position and said second position, and said contact transitions from the closed state to the open state in an OFF switching position that is between said second position and said third position, a minor peak appears between said first position and said second position, the minor peak being a peak in which the load once rises and then decreases when said movable member is pressed, said ON switching position is between a falling start position of said minor peak and said second position, and a maximum load during said minor peak is greater than or equal to a load in said ON switching position and less than or equal to a load in said OFF switching position.

2. The enabling switch according to claim 1, wherein the maximum load during said minor peak is less than a load in a position immediately before said OFF switching position and greater than a load in said second position.

3. The enabling switch according to claim 1, wherein said contact is closed when two terminals included in said contact gradually approach and come in contact with each other as said movable member is pressed in close proximity to said ON switching position toward said holder.

4. The enabling switch according to claim 1, further comprising:

a first engaging part; and a second engaging part that moves relative to said first engaging part in accordance with movement of said movable member, wherein when said movable member is pressed toward said holder, engagement of said first engaging part and said second engaging part is released during said minor peak of the load.

5. The enabling switch according to claim 1, further comprising:

a second contact, wherein said contact is a first contact, said contact mechanism causes said first contact and said second contact to transition from an open state to a close state and further from the closed state to the open state as said movable member is pressed toward said holder, said ON switching position is a first ON switching position, and said OFF switching position is a first OFF switching position, when said movable member is pressed, said second contact transitions from the open state to the closed state in a second ON switching position that is between said first position and said second position, and said second contact transitions from the closed state to the open state in a second OFF switching position that is between said second position and said third position, said first ON switching position and said second ON switching position are the same or in close proximity to each other, and said first OFF switching position and said second OFF switching position are the same or in close proximity to each other, said second ON switching position is between a falling start position of said minor peak and said second position, and the maximum load during said minor peak is greater than or equal to a greater one of a load in said first ON switching position and a load in said second ON switching position and less than a smaller one of a load in said first OFF switching position and a load in said second OFF switching position.

6. The enabling switch according to claim 5, wherein the maximum load during said minor peak is less than a load in a position immediately before said second OFF switching position and greater than a load in said second position.

7. The enabling switch according to claim 5, further comprising:

a first engaging part; and a second engaging part that moves relative to said first engaging part in accordance with movement of said movable member, wherein when said movable member is pressed toward said holder, engagement of said first engaging part and said second engaging part is released during said minor peak of the load.

8. The enabling switch according to claim 7, wherein said movable member is transversely elongated and pressed toward said holder in a direction perpendicular to a direction of elongation of said movable member, said contact mechanism includes a rotatable member that is long in said direction of elongation of said movable member and rotatable about a rotation axis parallel to said direction of elongation, said rotatable member is rotatably mounted directly or indirectly on either one of said movable member and said holder, said movable member is pressed toward said holder when said rotatable member is rotated with a press of said movable member while rotatable sliding contact parts that are located in opposite ends of said rotatable member in a longitudinal direction are in sliding contact with fixed sliding contact parts that are directly or indirectly fixed to the other of said movable member and said holder, and said fixed sliding contact parts include said first engaging part, and said rotatable sliding contact parts serve as said second engaging part.

9. The enabling switch according to claim 7, further comprising:

an elastic body that exerts a force between said first engaging part and said second engaging part, wherein when said movable member is pressed toward said holder, said second engaging part moves against the force exerted from said elastic body during said minor peak of the load so as to release engagement of said first engaging part and said second engaging part.

10. The enabling switch according to claim 9, wherein the maximum load during said minor peak is less than a load in a position immediately before said second OFF switching position and greater than a load in said second position.

11. The enabling switch according to claim 9 or 10, wherein said elastic body is directly or indirectly fixed to either one of said movable member and said holder, said second engaging part is directly or indirectly mounted on said elastic body, and said first engaging part is directly or indirectly fixed to the other of said movable member and said holder.

12. The enabling switch according to claim 1, wherein said minor peak rises almost vertically.

13. The enabling switch according to claim 1, wherein a position of the maximum load during said minor peak is closer to said first position than to a midpoint position between said first position and said second position.

* * * * *